US012232664B2

(12) United States Patent
Champagne et al.

(10) Patent No.: US 12,232,664 B2
(45) Date of Patent: Feb. 25, 2025

(54) SHOWER ASSEMBLY WITH INTEGRATED WATER COLLECTION AND DISPERSION

(71) Applicants: American Bath Group, LLC, Arlington, TX (US); Maax Bath INc., Montreal (CA)

(72) Inventors: Jean Sébastien Champagne, Montreal (CA); Martin Desaulniers, Montreal (CA); Christine Lacasse-Veilleux, Montreal (CA)

(73) Assignees: American Bath Group, LLC, Arlington (CA); Maax Bath Inc., Montreal (CA)

( * ) Notice: Subject to any disclaimer, the term of this patent is extended or adjusted under 35 U.S.C. 154(b) by 118 days.

(21) Appl. No.: 17/709,357

(22) Filed: Mar. 30, 2022

(65) Prior Publication Data

US 2022/0313027 A1 Oct. 6, 2022

Related U.S. Application Data

(60) Provisional application No. 63/168,241, filed on Mar. 30, 2021.

(51) Int. Cl.
*A47K 3/28* (2006.01)
*E03C 1/04* (2006.01)

(52) U.S. Cl.
CPC ..... *A47K 3/283* (2013.01); *E03C 1/0408* (2013.01)

(58) Field of Classification Search
CPC ..... A47K 3/008; A47K 3/28; A47K 3/283; A47K 3/284; A47K 3/40
See application file for complete search history.

(56) References Cited

U.S. PATENT DOCUMENTS

| | | | |
|---|---|---|---|
| 2,065,531 | A | 12/1936 | Kerr |
| 3,158,237 | A | 11/1964 | Schooler |
| 3,281,172 | A | 10/1966 | Kuehl |
| 3,519,527 | A | 7/1970 | Crowley |
| 3,772,138 | A | 11/1973 | Witman |
| 3,811,915 | A | 5/1974 | Burrell et al. |
| 4,097,635 | A | 6/1978 | Sanz Hernandez et al. |
| 4,169,907 | A | 10/1979 | Barker et al. |
| 4,187,131 | A | 2/1980 | Shortway et al. |
| 4,214,028 | A | 7/1980 | Shortway et al. |
| 4,217,385 | A | 8/1980 | Shortway et al. |
| 4,225,374 | A | 9/1980 | Kaufmann |

(Continued)

FOREIGN PATENT DOCUMENTS

| | | | |
|---|---|---|---|
| CA | 1243925 | A | 11/1988 |
| CN | 2497994 | Y | 7/2002 |

(Continued)

OTHER PUBLICATIONS

"Tile-Look FRP," <www.frpdesignsolutions.com>, Crane Composites, Inc., 2011.

(Continued)

*Primary Examiner* — Janie M Loeppke
(74) *Attorney, Agent, or Firm* — Bradley Arant Boult Cummings LLP; Phillip E. Walker; Alex H. Huffstutter

(57) ABSTRACT

A shower unit having an integrated locking system for ease of installation and preferably including a channel, baffling system, the retention cavity system that in combination to collect and direct fluid away from support walls and to a collection area.

29 Claims, 38 Drawing Sheets

(56) References Cited

U.S. PATENT DOCUMENTS

| | | | | |
|---|---|---|---|---|
| 4,233,343 | A | 11/1980 | Barker et al. | |
| 4,248,922 | A | 2/1981 | Shortway et al. | |
| 4,298,646 | A | 11/1981 | Haemer et al. | |
| 4,329,822 | A | 5/1982 | Russell | |
| 4,384,377 | A * | 5/1983 | Calvert | A47K 3/08 4/612 |
| 4,446,177 | A | 5/1984 | Munoz et al. | |
| 4,471,501 | A * | 9/1984 | Heymann | A47K 3/284 4/596 |
| 4,500,373 | A | 2/1985 | Kubota | |
| 4,579,767 | A | 4/1986 | Coggan et al. | |
| 4,581,255 | A | 4/1986 | Coggan et al. | |
| 4,617,222 | A | 10/1986 | Courtoy et al. | |
| 4,789,604 | A | 12/1988 | van der Hoeven | |
| RE33,599 | E | 5/1991 | Courtoy et al. | |
| 5,052,160 | A | 10/1991 | Gentsch et al. | |
| 5,142,836 | A | 9/1992 | Kearns | |
| 5,219,787 | A | 6/1993 | Carey et al. | |
| 5,270,097 | A | 12/1993 | Amemiya et al. | |
| 5,303,519 | A * | 4/1994 | Mustee | A47K 3/283 52/592.1 |
| 5,304,272 | A | 4/1994 | Rohrbacker et al. | |
| 5,634,307 | A | 6/1997 | Larriberot et al. | |
| 5,866,225 | A | 2/1999 | Crossley | |
| 5,919,554 | A | 7/1999 | Watterson et al. | |
| 6,106,952 | A | 8/2000 | Yamashita et al. | |
| 6,117,384 | A | 9/2000 | Laurin et al. | |
| 6,146,711 | A | 11/2000 | Courtoy et al. | |
| 6,150,009 | A | 11/2000 | Stecker | |
| 6,486,903 | B1 | 11/2002 | Wagner et al. | |
| 6,516,476 | B1 | 2/2003 | Thums | |
| 6,835,420 | B1 | 12/2004 | Rockrath et al. | |
| 7,025,013 | B1 | 4/2006 | Staerzl et al. | |
| 7,131,380 | B2 | 11/2006 | Huffer | |
| 8,501,069 | B1 | 8/2013 | Williamson et al. | |
| 8,640,390 | B2 | 2/2014 | Schlueter | |
| 9,504,359 | B2 | 11/2016 | Seckler et al. | |
| 9,506,253 | B2 | 11/2016 | Rosko et al. | |
| 9,518,392 | B2 | 12/2016 | Morneau et al. | |
| 9,833,111 | B2 | 12/2017 | Torres | |
| 9,848,741 | B2 * | 12/2017 | Slothower | A47K 3/283 |
| 10,144,243 | B2 | 12/2018 | Domanico | |
| 10,273,697 | B2 | 4/2019 | Horton et al. | |
| 10,870,313 | B2 | 12/2020 | Lacasse-Veilleux et al. | |
| 10,933,686 | B2 | 3/2021 | Bilodeau | |
| 11,053,689 | B2 | 7/2021 | Zimbric et al. | |
| 11,325,415 | B2 | 5/2022 | Lacasse-Veilleux et al. | |
| 11,700,974 | B2 * | 7/2023 | Ferris | A47K 3/008 4/595 |
| 2001/0002293 | A1 | 5/2001 | Eby et al. | |
| 2001/0055662 | A1 | 12/2001 | Fusco | |
| 2002/0127372 | A1 | 9/2002 | Waite et al. | |
| 2002/0146954 | A1 | 10/2002 | Drees et al. | |
| 2002/0160680 | A1 | 10/2002 | Laurence et al. | |
| 2003/0003827 | A1 | 1/2003 | Mikats | |
| 2003/0086603 | A1 | 5/2003 | Davidson et al. | |
| 2003/0113520 | A1 | 6/2003 | Takashi et al. | |
| 2003/0138617 | A1 | 7/2003 | Courtoy et al. | |
| 2003/0180509 | A1 | 9/2003 | Wright et al. | |
| 2004/0170873 | A1 | 9/2004 | Smith | |
| 2004/0219339 | A1 | 11/2004 | Dempsey et al. | |
| 2005/0055931 | A1 | 3/2005 | Rochette | |
| 2005/0200043 | A1 | 9/2005 | Leu et al. | |
| 2005/0227006 | A1 | 10/2005 | Segall | |
| 2006/0000173 | A1 | 1/2006 | Edstrom | |
| 2006/0068213 | A1 | 3/2006 | O'Brien et al. | |
| 2006/0136083 | A1 | 6/2006 | Hansson et al. | |
| 2007/0187864 | A1 | 8/2007 | Mincey et al. | |
| 2007/0202305 | A1 | 8/2007 | Sun | |
| 2007/0218252 | A1 | 9/2007 | Donald | |
| 2008/0115437 | A1 | 5/2008 | Bordener | |
| 2008/0250558 | A1 | 10/2008 | Torres | |
| 2008/0311346 | A1 | 12/2008 | Ohno | |
| 2009/0035473 | A1 | 2/2009 | Jaworowski et al. | |
| 2009/0061184 | A1 | 3/2009 | Jaworowski et al. | |
| 2009/0068418 | A1 | 3/2009 | Iwase et al. | |
| 2010/0151225 | A1 | 6/2010 | Mabey | |
| 2011/0183153 | A1 | 7/2011 | Schlueter | |
| 2011/0223389 | A1 | 9/2011 | Lin et al. | |
| 2013/0019552 | A1 | 1/2013 | Murdock et al. | |
| 2014/0120329 | A1 | 5/2014 | Hu et al. | |
| 2014/0331585 | A1 | 11/2014 | Morneau et al. | |
| 2015/0024166 | A1 | 1/2015 | Bilodeau | |
| 2015/0107018 | A1 | 4/2015 | Vagedes | |
| 2015/0300028 | A1 | 10/2015 | Chase | |
| 2015/0361673 | A1 | 12/2015 | Rosko et al. | |
| 2016/0160496 | A1 | 6/2016 | Seckler et al. | |
| 2016/0236507 | A1 | 8/2016 | Domanico | |
| 2017/0071415 | A1 | 3/2017 | Rosko et al. | |
| 2017/0071416 | A1 | 3/2017 | Seckler et al. | |
| 2017/0274702 | A1 | 9/2017 | Bilodeau | |
| 2018/0058076 | A1 | 3/2018 | Horton et al. | |
| 2019/0322127 | A1 | 10/2019 | Lacasse-Veilleux et al. | |
| 2021/0032874 | A1 | 2/2021 | Zimbric et al. | |
| 2021/0070099 | A1 | 3/2021 | Lacasse-Veilleux et al. | |

FOREIGN PATENT DOCUMENTS

| | | | |
|---|---|---|---|
| EP | 2 175 082 | A1 | 4/2010 |
| FR | 1471270 | A | 3/1967 |
| GB | 1388536 | A | 3/1975 |
| GB | 2428406 | A | 1/2007 |
| WO | WO 96/026987 | | 9/1996 |
| WO | WO 2009/124434 | A1 | 10/2009 |

OTHER PUBLICATIONS

International Search Report and Written Opinion mailed Jan. 14, 2013, in corresponding PCT Application No. PCT/CA2012/000929.
International Preliminary Report on Patentability dated Jan. 29, 2014, in corresponding PCT Application No. PCT/CA2012/000929.

* cited by examiner

SHOWER ASSEMBLY WITH INTEGRATED WATER COLLECTION AND DISPERSION

This is a non-provisional patent application claiming priority to U.S. Provisional Patent Application Ser. No. 63/168,241 filed Mar. 30, 2021 and entitled "Improved Shower Assembly with Integrated Water Collection and Dispersion".

This non-provisional patent application is filed by applicants American Bath Group, LLC a Delaware company and Maax Bath Inc. of Montreal, Canada, for the inventors Jean Sébastien Champagne, a citizen of Canada, residing in Montreal, Martin Desaulniers, a citizen of Canada, residing in Montreal, and Christine Lacasse-Veilleux a citizen of Canada, residing in Montreal, for the invention of an "Improved Shower Assembly with Integrated Water Collection and Dispersion".

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND

Technical Field

The present disclosure relates to shower assemblies, which can also be described as shower surrounds, shower units, or showers, and more particularly to shower assemblies that reduce installation time, improve fluid collection and dispersion, and direct fluids from the showering process to a collection area.

Background Art

Shower assemblies, shower units, or showers, are known in the art. Showers are typically combinations of manufactured and assembled walls, and potentially a base, or shower pan, that are either freestanding or attached to walls of a building or dwelling, such as a home, office, hospital, or the like, to provide a location, such as in a bathroom, for someone to clean themselves. Shower units are usually manufactured at a facility, or factory, and then shipped to the location where the shower will be installed.

Shower assemblies generally come and two forms. The first is a fully complete unit that is formed or manufactured as a whole piece in the factory. The second is a shower unit that is made in pieces and ship to the building in pieces and assembled on site. Many aspects factor into which of the two shower units are made. These including the style of the unit, the size of the unit, the space within the building where the unit will be placed, construction of the building where the unit will be placed, and egress to the location where the shower will be installed. In situations where a unit is shipped in pieces and then assembled, the construction of that unit within the bathroom where it is installed can be time and labor-intensive. Traditionally during the installation process, a sealant, such as caulk, is used in the assembly of the shower unit. The sealant is normally hand laid by the construction worker and is used to try and to restrict water flow from exiting the shower area at the seams and joints form between the various pieces of the shower unit.

Traditionally, water issues can arise if the installation person does not properly seal the shower unit. For example, if the unit is not properly assembled, which traditional means a liberal use of sealant, water can escape through gaps, cracks, and crevices between the pieces and get behind the shower unit. This moisture behind the walls can make the walls and surrounding areas behind the shower unit damp. If unchecked, this dampness can lead to mold growth and in some cases deterioration, damage, and destruction to the structure of the building around the shower, including the walls, such as sheet rock or dry walls, the insulation, and supports, such as the wooden studs and flooring of the building used as support for the shower unit itself.

The problem of maintaining the water within the confines and structure of the shower can be further exacerbated by modern shower design that can include multiple water dispersion locations, such as multiple shower heads, and high-pressure dispersion locations. The use of these multiple and/or high-pressure water dispersion locations can increase the likelihood that water will penetrate even small seams, joints, or gaps left by the installation process, or naturally occurring in the shower once assembled. These multiple locations and high-pressure dispersions can also send water high in the air. This can lead to water hitting surfaces above the tops of the shower walls. Again, this can lead to water getting behind the shower walls and cause the afore mentioned mold and damage issues.

Additional problems associated with conventional showers and the modern showering process are the additional fluids used in the cleaning process. Most people that take showers use various cleaning products during the showering process, such as some form of soap, shampoo, and even conditioner. Most of these products have a "suds" effect that is designed to aid in the cleaning process. These remnants of the cleaning products travel with the water in the shower and are spread about the shower area, especially with the deflection of the fluids by the water off of the body of the person showering. This can lead to a build of these remnants throughout the shower area. These remnants can also be pushed by the water into the seams, joints, or gaps left from the assembly process as previously mention. These fluids can further exacerbate the mold and damage issues with additional fluids behind the walls of the shower units.

What is needed then are improved showers that can be assembled quickly and efficiently. These improved showers preferably have integrated fluid collection features and systems that direct fluids away from the walls of the structure on which they are installed and to the drain of the shower unit.

BRIEF SUMMARY

The present disclosure provides shower units for placement proximate to one or more walls of a building. The shower units have improved assembly characteristics and integrated water collection and dispersion features.

In some embodiments, the present disclosure provides a shower unit with a base, a first panel, and a second panel. The base can have a length, a width, a collection area, a first edge, and a second edge. The first panel can have a wall side, an exposed side, a first height, a first panel attaching side, a first base end, and a first partial channel. The first base end can be shaped to engage the first edge of the base, while the first panel attaching side can include a first interlocking member. The second panel can include a wall side, an exposed side, a second height approximately equal the first height, a second panel attaching side, a second base end, and a second partial channel. The second base end can be shaped to engage the second edge of the base, while the second panel attaching side can include a second interlocking member shaped to accept the first interlocking member and secure the first panel attaching side to the second panel attaching side.

In an embodiment of the shower unit, when the first panel is attached to the second panel, the first partial channel and the second partial channel form a channel extending substantially the first height and the second height. The first partial channel can be spaced from the exposed side of the first panel and the second partial channel can be spaced from the exposed side of the second panel.

The channel can be shaped to direct water down toward the base and away from the one or more walls. Further, the channel can be shaped to direct water toward the collection area. The channel can include a cross-sectional area that varies, with the cross-sectional narrowing as the channel approaches the base.

In an embodiment of the shower unit, the first panel can further include at least one first baffling section positioned proximate the first partial channel and the second panel can further include at least one second baffling section positioned proximate the second partial channel. The first baffling location and the second baffling location can form a baffling area when the first panel is attached to the second panel. Further, the first panel can include a plurality of first baffling sections positioned proximate the first partial channel with those first baffling sections spaced along the first height. The second panel can include a plurality of second baffling sections positioned proximate the second partial channel and those spaced second baffling sections along the second height. When the first panel is attached to the second panel, each first baffling section can combine with one of the second baffling sections to form a baffling area, wherein the baffling areas form a baffling system. Preferably, the baffling system includes angled surfaces positioned to direct fluid from the channel to one of the exposed sides of the first panel or the second panel.

The first baffling section can include a declined surface, a first angled surface, and a second angled surface. The declined surface can extend from the channel towards the exposed surface of the first panel. The first angled surface can be positioned adjacent to the declined surface to direct fluid toward the declined surface. The second angled surface can be positioned opposite the first angled surface to direct fluid toward the declined surface.

In an embodiment of the shower unit, the shower unit can include a corner gasket and a first gasket. The corner gasket can be shaped to engage the first panel proximate the first panel attaching side and the second panel proximate the second panel attaching side. The corner gasket can space the first panel and the second panel from the collection area of the base. The first gasket can be part of the first panel and be positioned on the wall side of the first panel proximate the first base end. The first gasket can be shaped to engage the base proximate the first edge of the base.

In an embodiment of the shower unit, the first panel attaching side can include a vertical barrier that extends a majority of the first height while the second panel attaching side can include a cavity that extends a majority of the second height. The vertical barrier and the cavity form a retention cavity system when the first panel is attached to the second panel. In some embodiments, the channel can be positioned between the retention cavity system and the exposed sides of the panels. The retention cavity system can extend to the first base end and can be positioned to direct fluid under the first base end of the first panel and into the collection area of the base. The retention cavity system can extend through the first interlocking member and the second interlocking member when the first panel is attached to the second panel.

In an embodiment of the shower unit, the second panel can include a mirror panel attaching side and a mirror partial channel. The mirror panel attaching side can include a mirror interlocking member. Further, a third panel can be included. The third panel can include a wall side, an exposed side, a third height approximately equal to the first height, a third panel attaching side, a third base end, and a third partial channel. The third base end can be shaped to engage a third edge of the base. The third panel attaching side can include a third interlocking member than can attached to the mirror interlocking member of the second panel. The mirror interlocking member can be shaped to accept the third interlocking member and secure the mirror panel attaching side to the third panel attaching side.

It is therefore a general object of the current disclosure to provide a shower unit with an improved fluid collection and dispersion system.

Another object of the current disclosure is to provide a shower unit design to keep fluid from getting behind the walls of the unit.

Still another object of the current disclosure is to provide a shower unit that does not need a sealant during assembly.

Still another object of the current disclosure is to provide a shower unit that has multiple locations to direct fluid back to the base collection area of the shower.

Numerous other objects, features and advantages of the present disclosure will be readily apparent to those skilled in the art upon a reading of the following description when taken in conjunction with the accompanying drawings.

BRIEF DESCRIPTION OF THE DRAWINGS

FIG. 47 is a partial view of the bottom corner showing the connection of the first and second panels connect but spaced before final seating there on.

DETAILED DESCRIPTION

Figure 1:
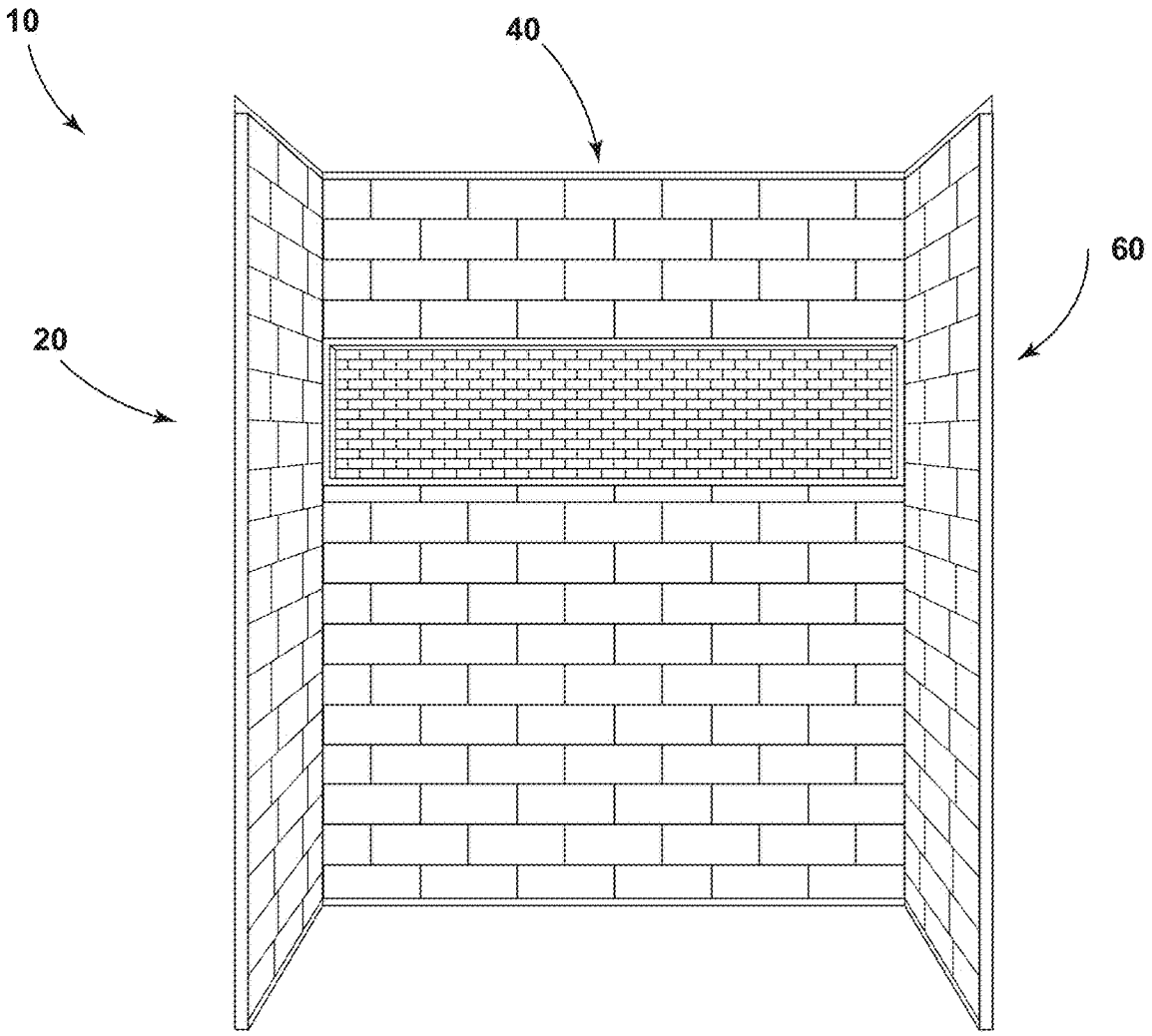
FIG. 1 is a front perspective view of a shower unit made in accordance with the current disclosure.
Figure 2:
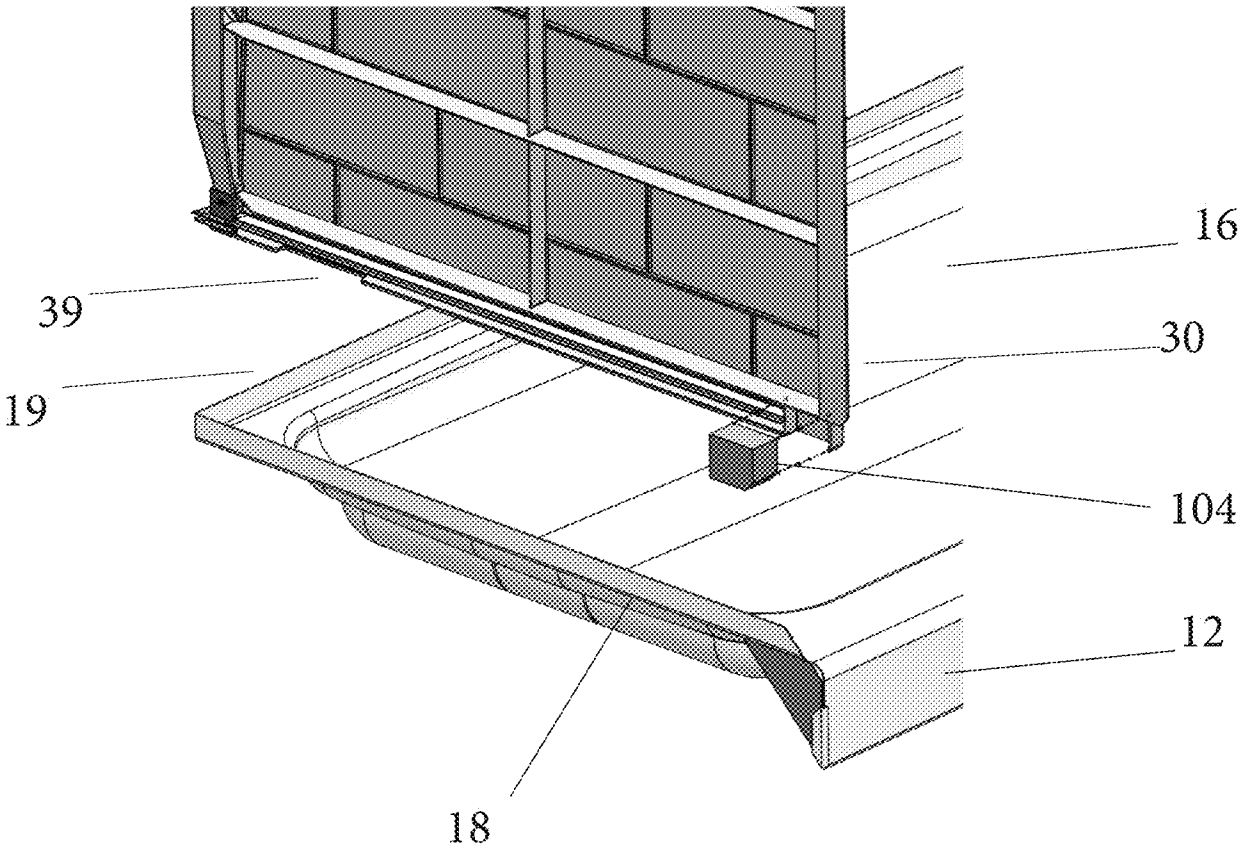
FIG. 2 is a partial assembly view of a first panel in relation to the base of a shower unit made in accordance with the current disclosure.
Figure 3:
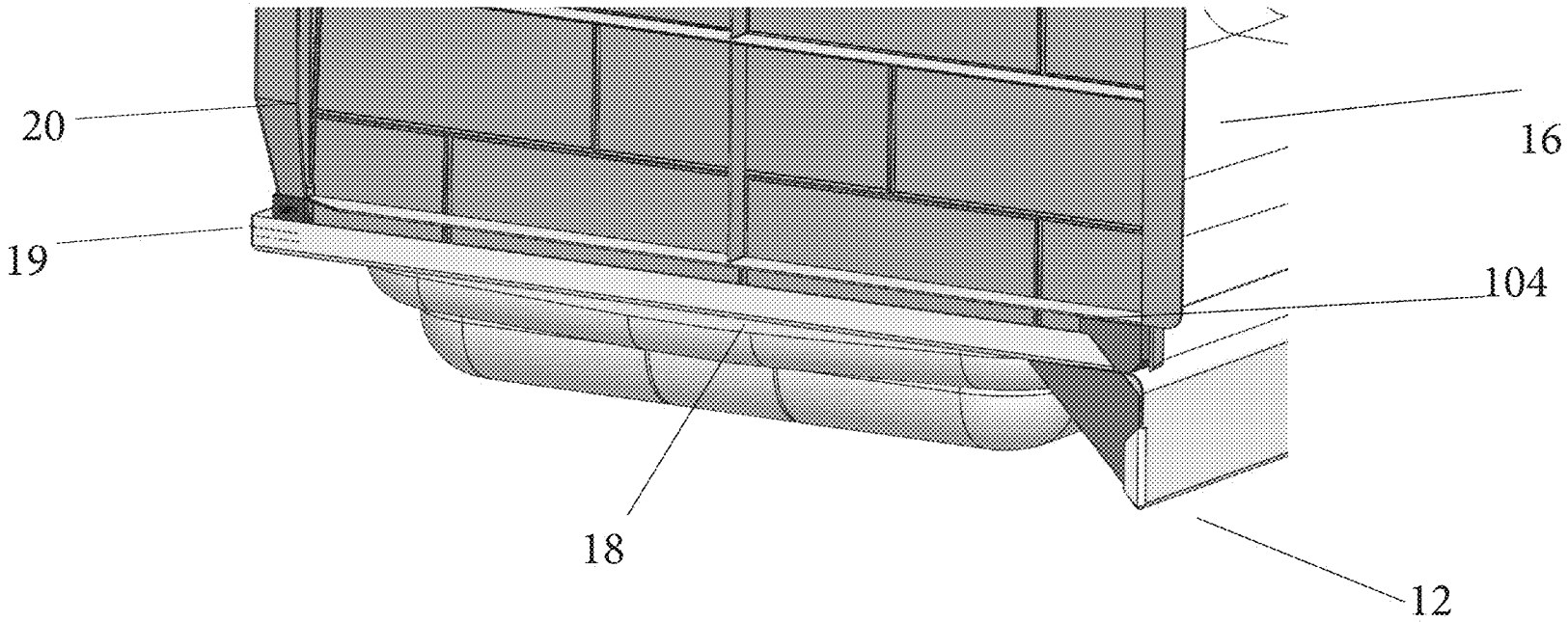
FIG. 3 is the assembled view of FIG. 2.
Figure 4:
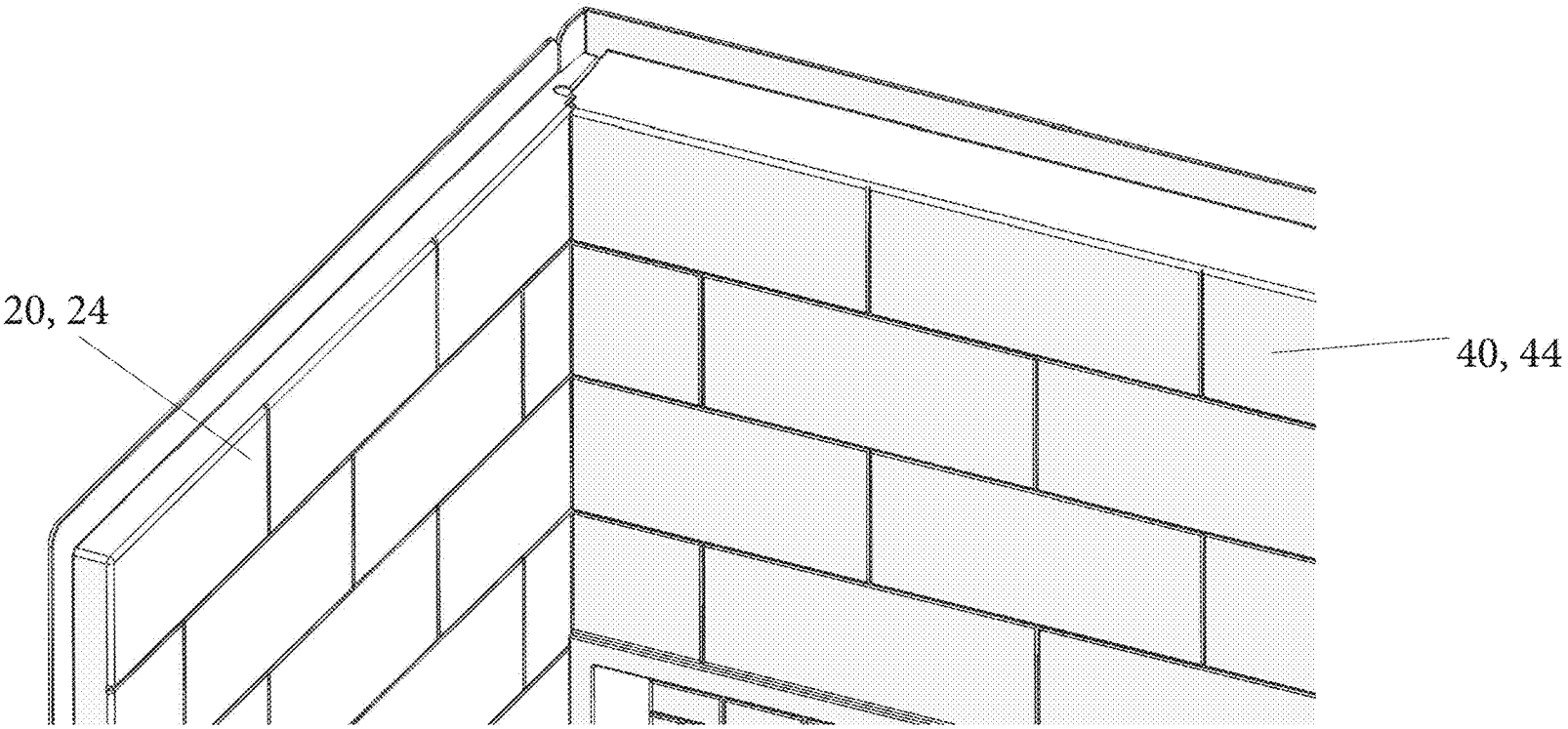
FIG. 4 partial assembly view of a first panel attached to a second panel of a shower unit as made in accordance with the current disclosure.
Figure 5B:
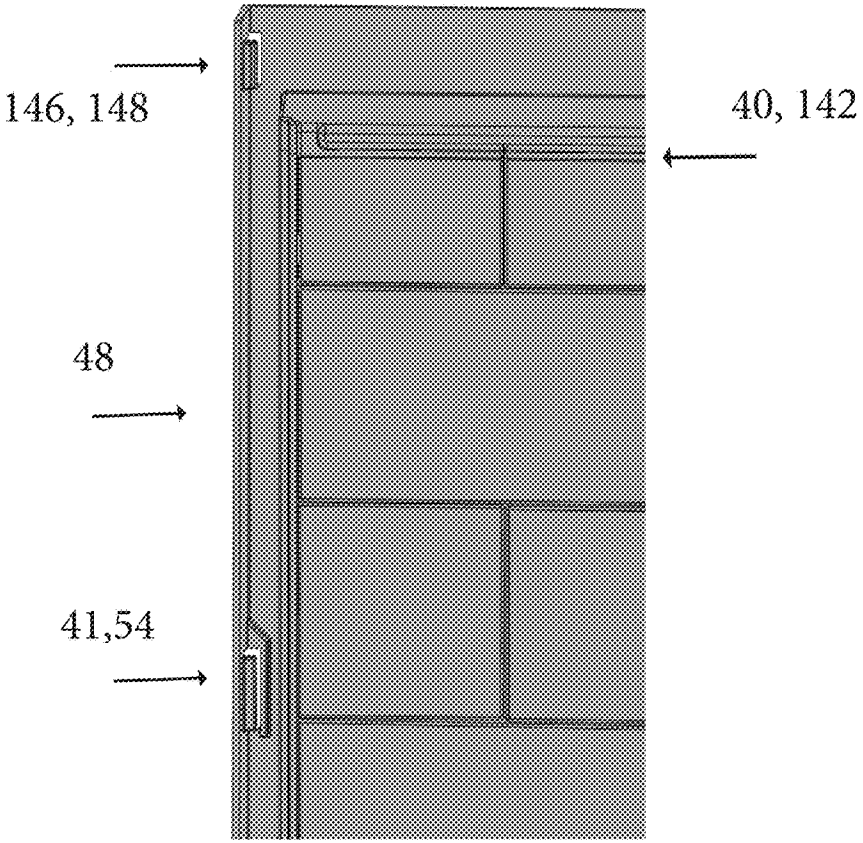
FIG. 5B is partial front view of a bottom section of a second panel showing the interlocking member and connector made in accordance with the current disclosure.
Figure 5A:
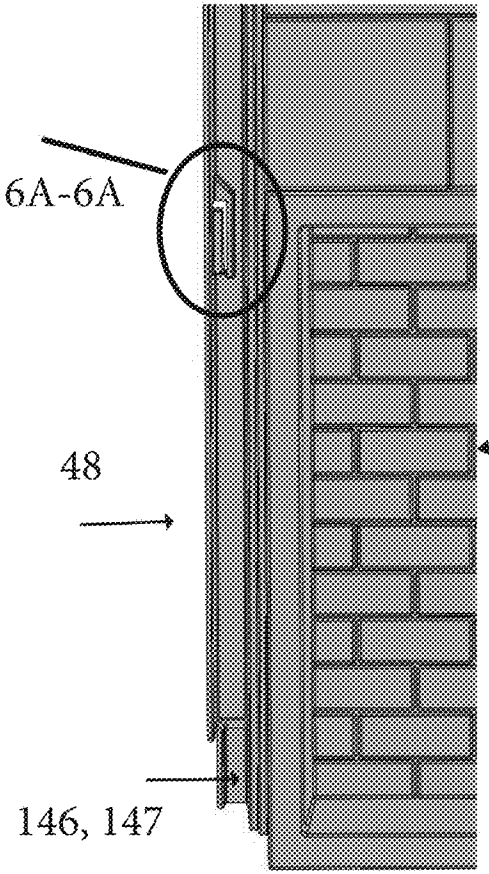
FIG. 5A is partial front view of top section of a second panel showing the interlocking member, seat, and inset made in accordance with the current disclosure.
Figure 6B:
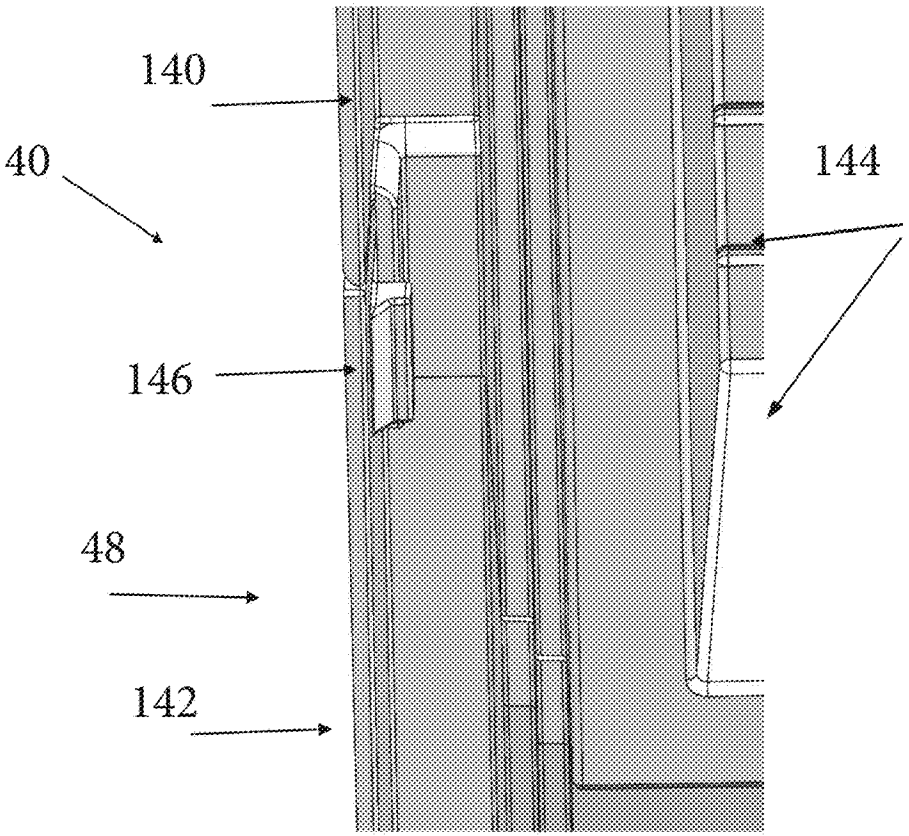
FIG. 6B is front view of the top section and the bottom section of the second panel assembled using the seat and connector in accordance with the current disclosure.
Figure 6A:
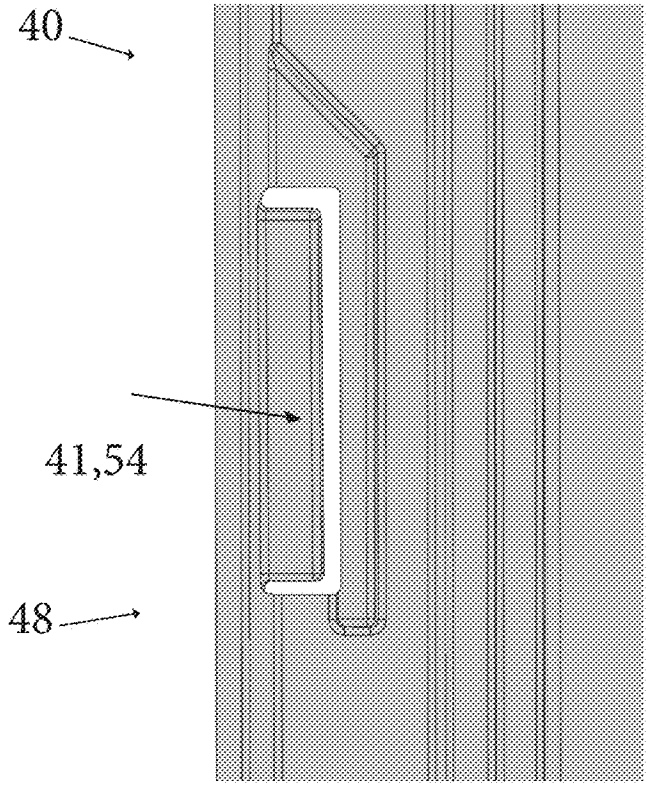
FIG. 6A a detailed view of inset 6A-6A from FIG. 5A.

Referring generally now to FIGS. 1-48, one embodiment of the present disclosure provides a shower unit 10. It is understood that, for the sake of clarity, not all reference numbers are included in each drawing. In addition, positional terms such as a "upper," "lower," "side," "top," "bottom," "vertical," "horizontal," etc. refer to the apparatus when in the orientation shown in the drawing. The skilled artisan will recognize that objects in accordance with the present disclosure can assume different orientations when in use.

Referring now to FIG. 1, the shower unit 10, which can also be described as a shower assembly, shower surround, or shower, is preferably manufactured, assembled and attached to walls (not shown) of a building (not shown). The building can be any of those buildings known in the art, such as a dwelling, home, office, hospital, and the like, that has a location, such as in a bathroom, for someone to clean himself or herself. Typically, the walls to which the shower 10 is attached will include a surface, such as sheet rock or dry walls, insulation, and supports, such as the wooden studs. The shower unit will also typically be supported by flooring of the building, such as additional supports and subflooring, as is known in the art.

In a preferred embodiment, the shower 10 includes a base 12, a first panel 20, a second panel 40, and a third panel 60. The base 12 includes a collection area 16, a first edge 18, and a second edge 19, the first and second edges can be described as flanges. The length and width of the base 12 can vary according designer preference and to conform to the space where the shower 10 is to be installed. The collection area 16 can include a drain (not shown) as known in the art. The collection area 16 is designed to collect the fluids from the showering process and direct them to the drain and ultimate removal from the shower area. The base 12 can include a trough area 14 to direct water collected during the showing process towards the center cavity area 16 and to the drain.

The first panel 20 includes a wall side 22 and an exposed side 24, or exposed surface 24, while the second panel 40 includes a wall side 42 and an exposed side 44, or exposed surface 44. The wall sides 22 and 42 are designed to set against and attach to walls of the dwelling where the shower 10 is position. The expose sides 24 and 44 are designed to direct water down to the collection area 16 of the base 12 and can have any aesthetically pleasing appearance as desired and known in the art.

The first panel 20 includes a first base end 30 shaped to engage the first edge 18 of the base 12, while the second panel 40 includes a second base end 50 shaped to engage the second edge 19 of the base 12. This engagement positions the exposed sides 24 and 44 within the footprint of the base 12 to facilitate fluid movement down the to the collection area 16 during the showering process.

Figure 8:
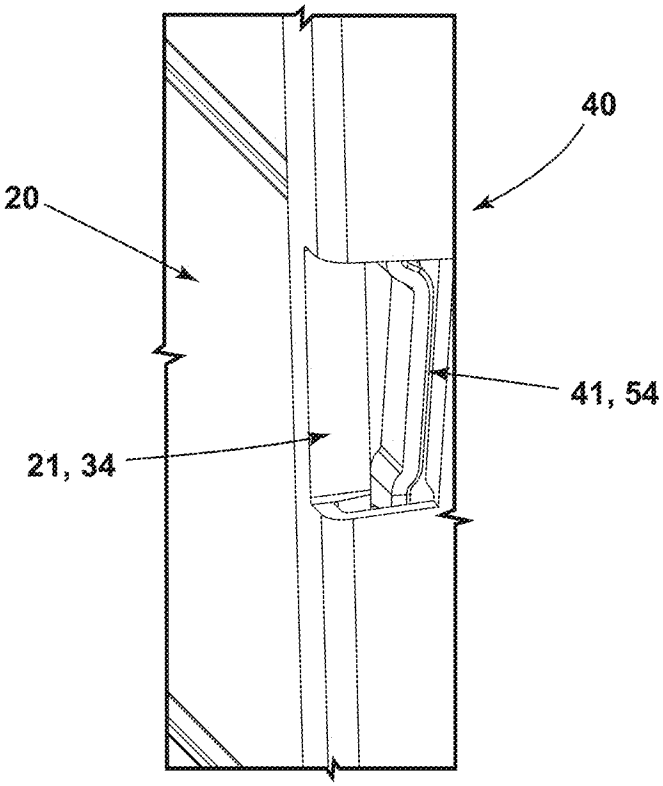
FIG. 8 is the assembled view of the interlocking members.
Figure 7:
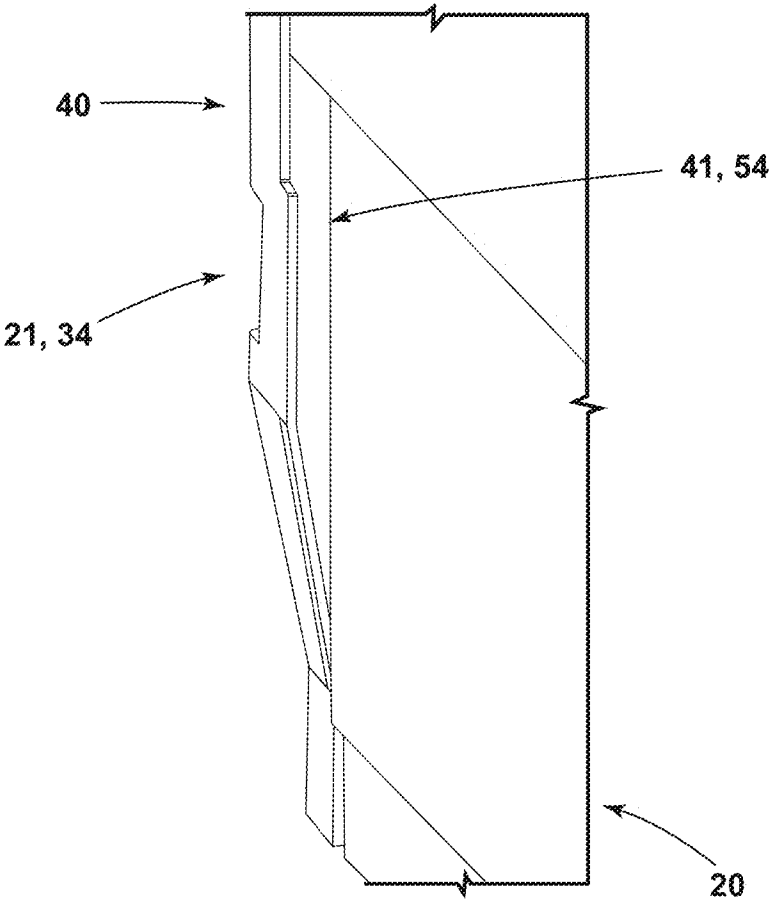
FIG. 7 is the assembled view showing a first panel connected to a second panel, the first panel shown in shadow lines.

The first panel 20 includes a first panel attaching side 28 with a first interlocking member 34. The second panel 40 includes a second panel attaching side 48 with a second interlocking member 54. As best seen in FIGS. 5-8, the interlocking members 34 and 54 include at least one aperture 21 and at least one protrusion 41. The aperture 21 and protrusion 41 interconnect and have a frictional fit that can secure the first panel 20 to the second panel 40. In the examples shown in the figures, the first panel 20 includes the aperture 21 while the second panel 40 includes the protrusion 41. This configuration can be reversed. FIGS. 7 and 8 show the interconnection between these two features. The third panel 60 can be a mirror of the first panel 20. The third panel 60 can connect to the mirror panel attaching side 56 of the second panel 40 when it is desired to have three walls as part of the shower unit 10. This can be accomplished by the third panel 60 having a third interlocking member, similar to the first interlocking member, and the second panel 40 having a mirror interlocking member, similar to the second interlocking member.

When the first panel 20 is interlocked with the second panel 40 one of three features can be formed. First, as best seen in FIGS. 16-21 a channel 80 can be formed when first panel 20 is connected to the second panel 40. The channel is preferably formed by a first partial channel 32 on the first panel 20 and a second partial panel 52 on the second panel 40. The first partial channel 32 extends substantially the first height 26 and the second partial panel 52 extends substantially the second height 46. As a result, the channel 80 can extend substantially the first height 26 and the second height 46.

Figure 16:
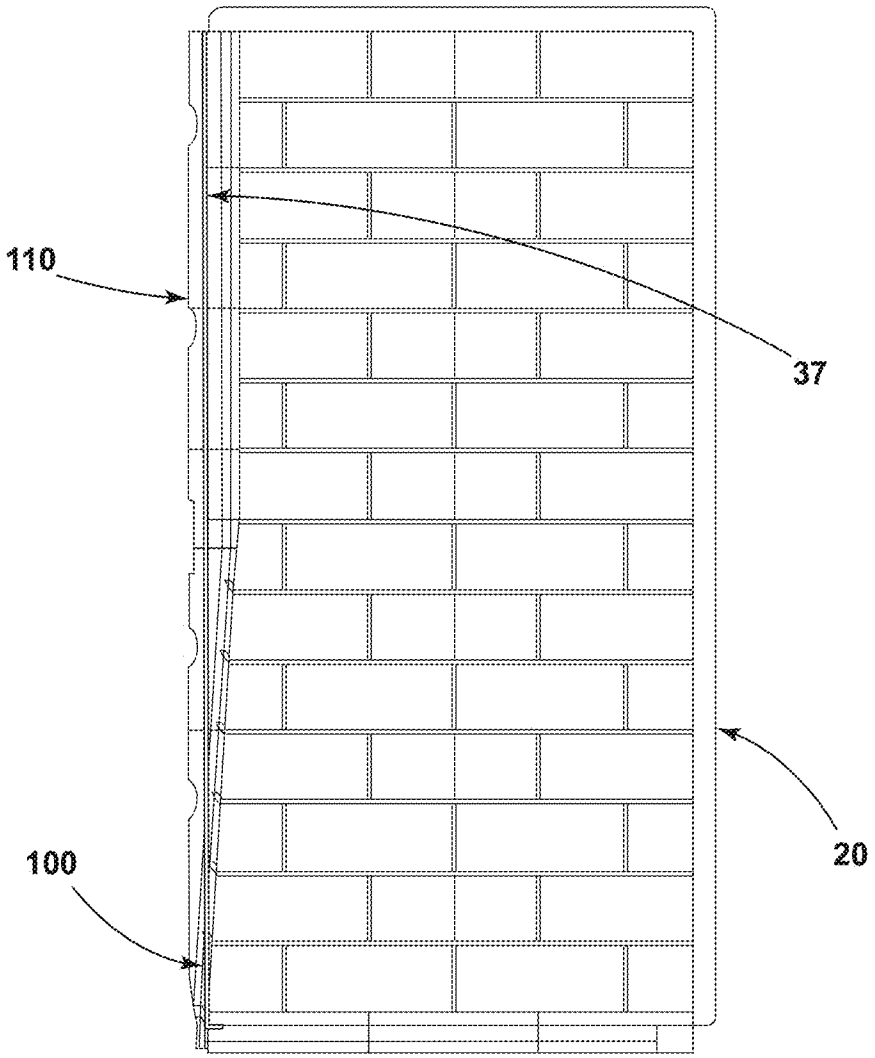
FIG. 16 is a side view similar to FIG. 14.
Figure 17:
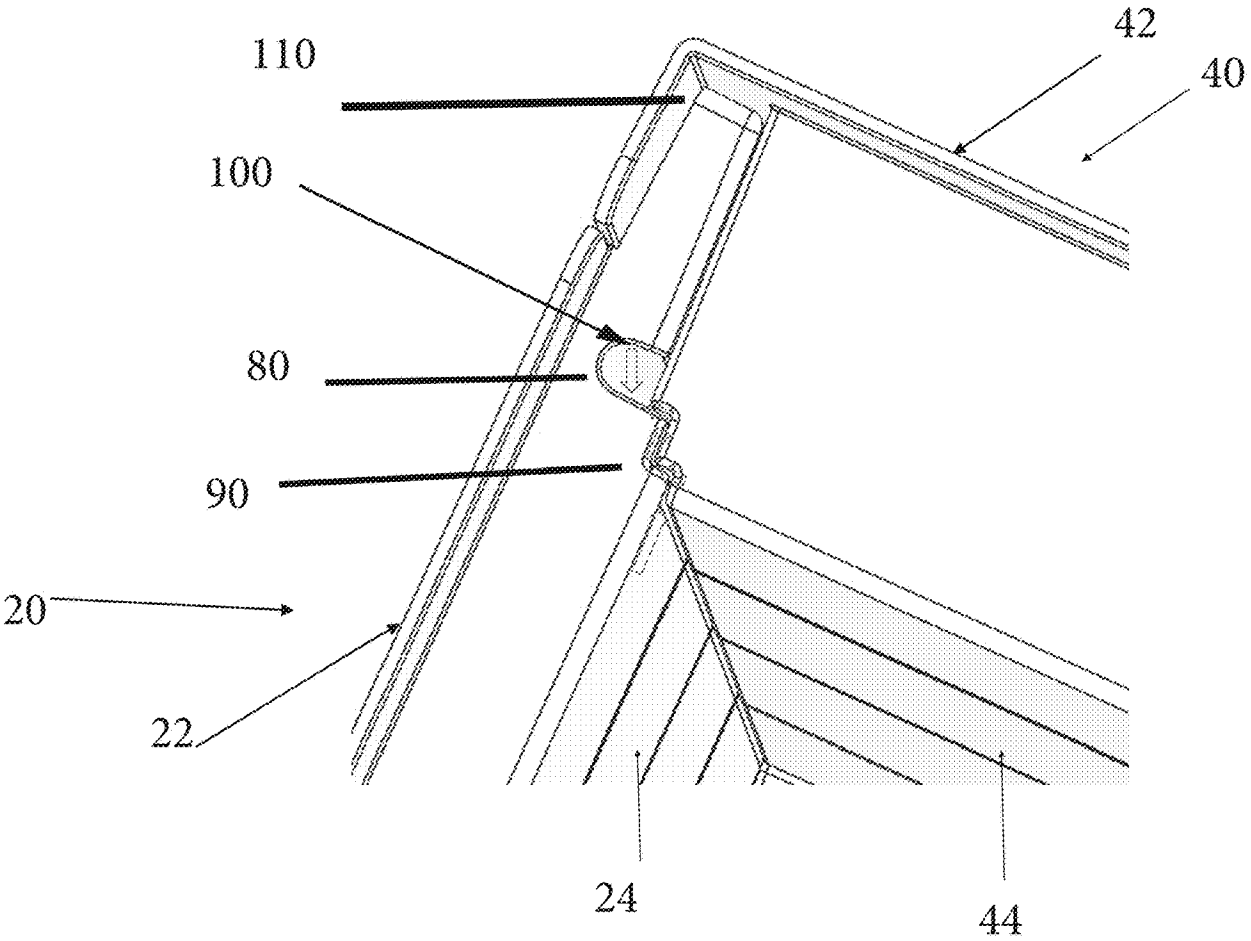
FIG. 17 partial top view showing an embodiment with a channel, a baffling system, and a retention cavity system of a shower unit made in accordance with the current disclosure.
Figure 18:
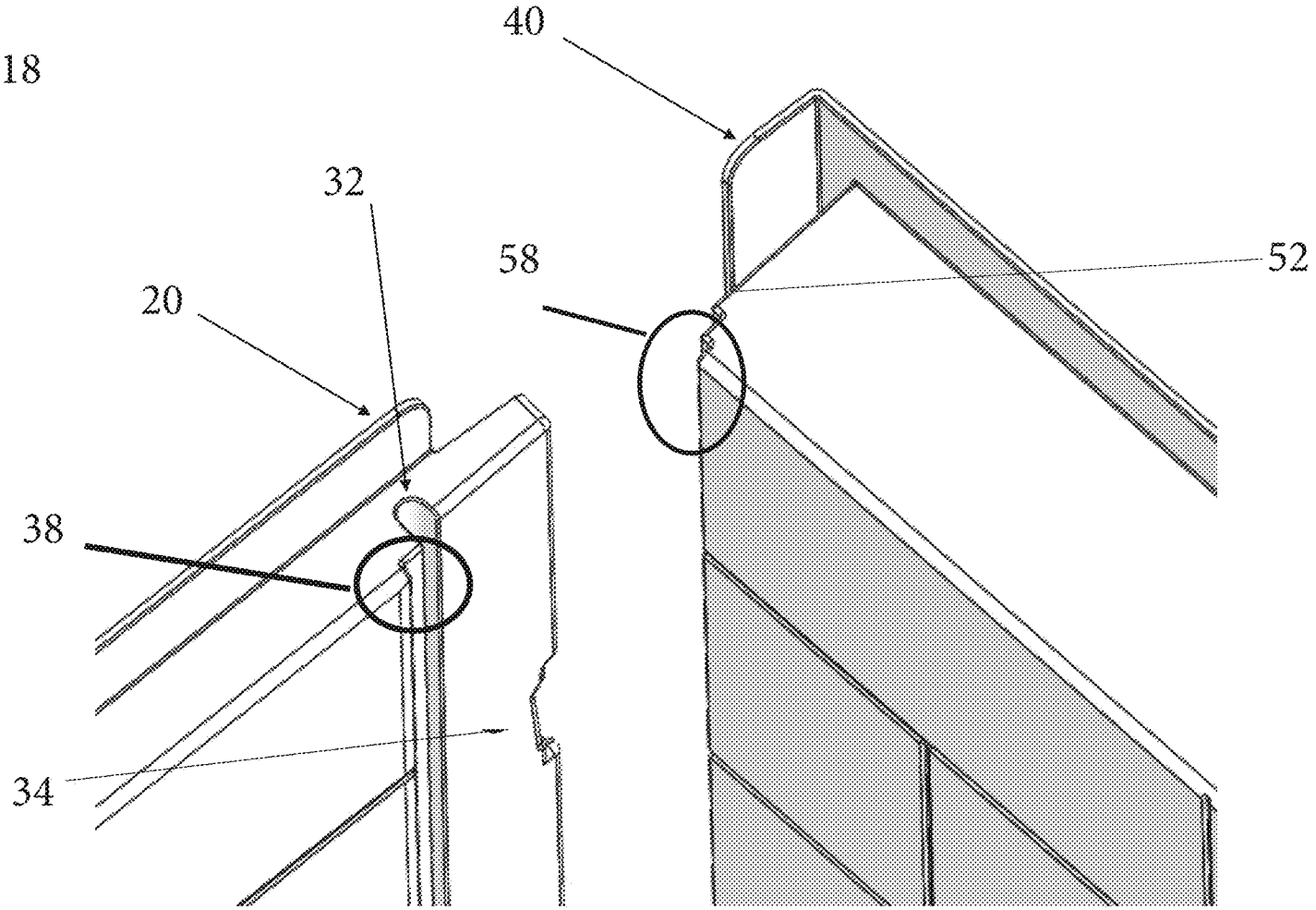
FIG. 18 is an assembly view of FIG. 17.
Figure 19:
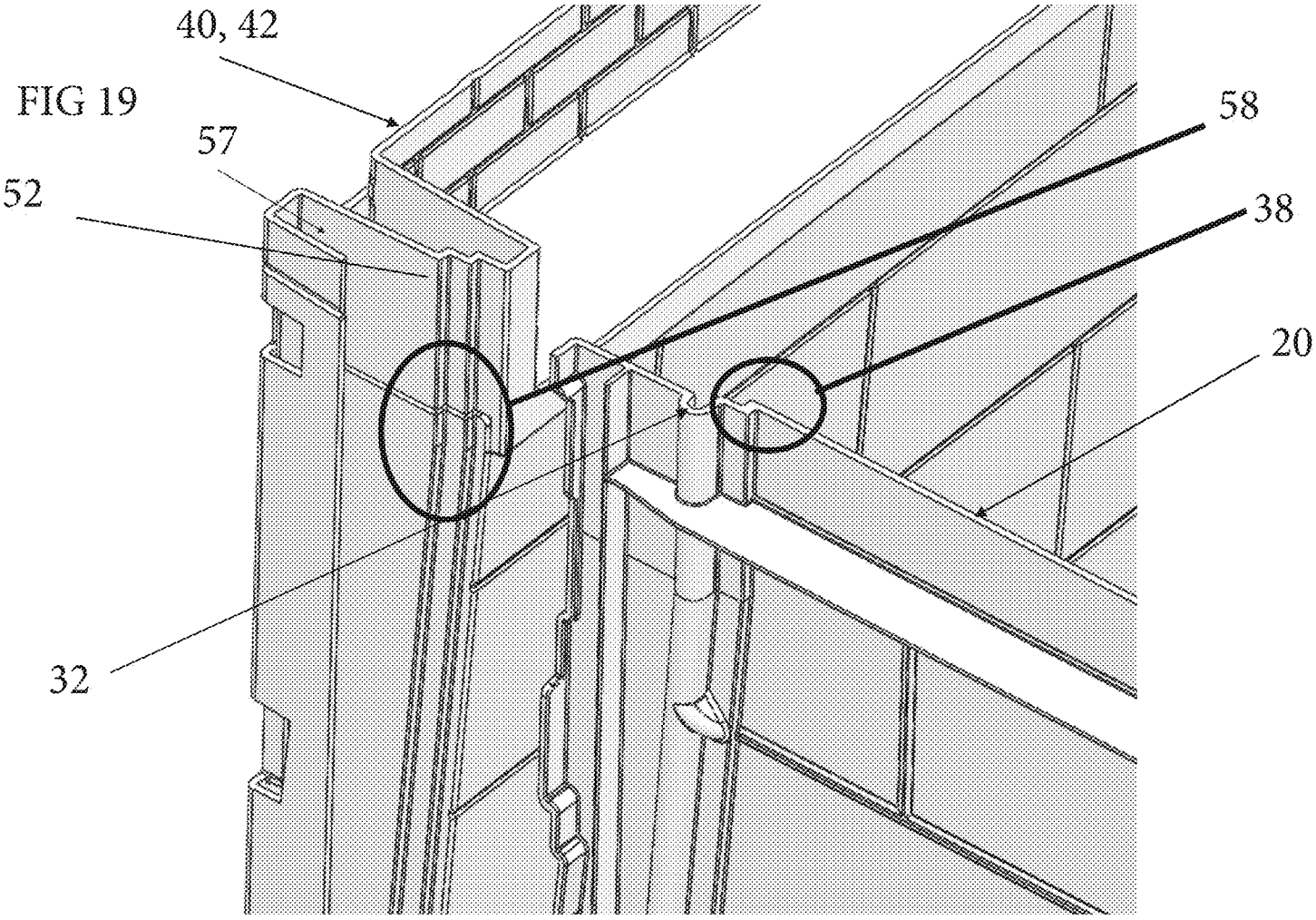
FIG. 19 is an alternate assembly view similar to FIG. 18.
Figure 20:
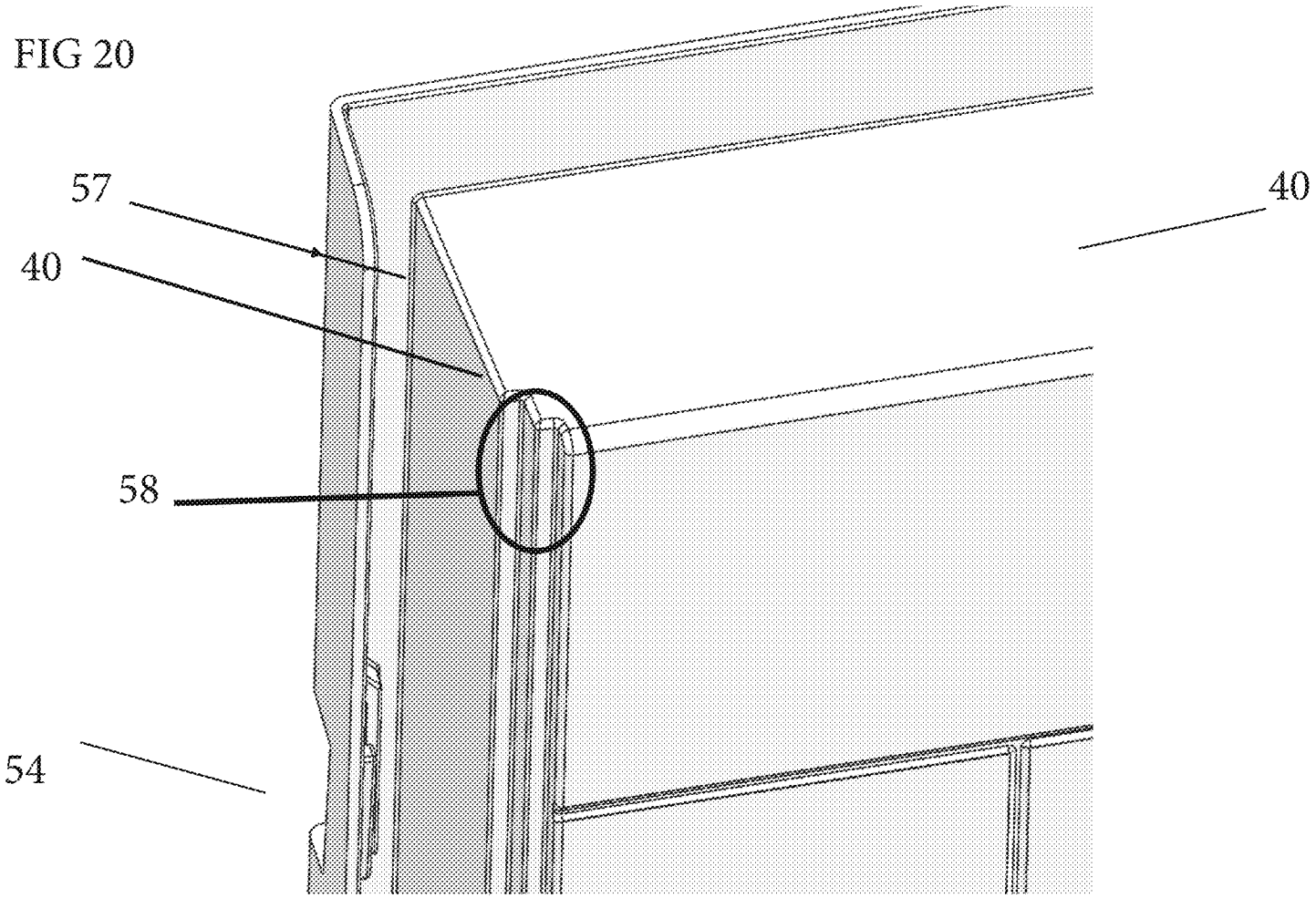
FIG. 20 is a partial perspective view of the top of a second panel made in accordance with the current disclosure.
Figure 21:
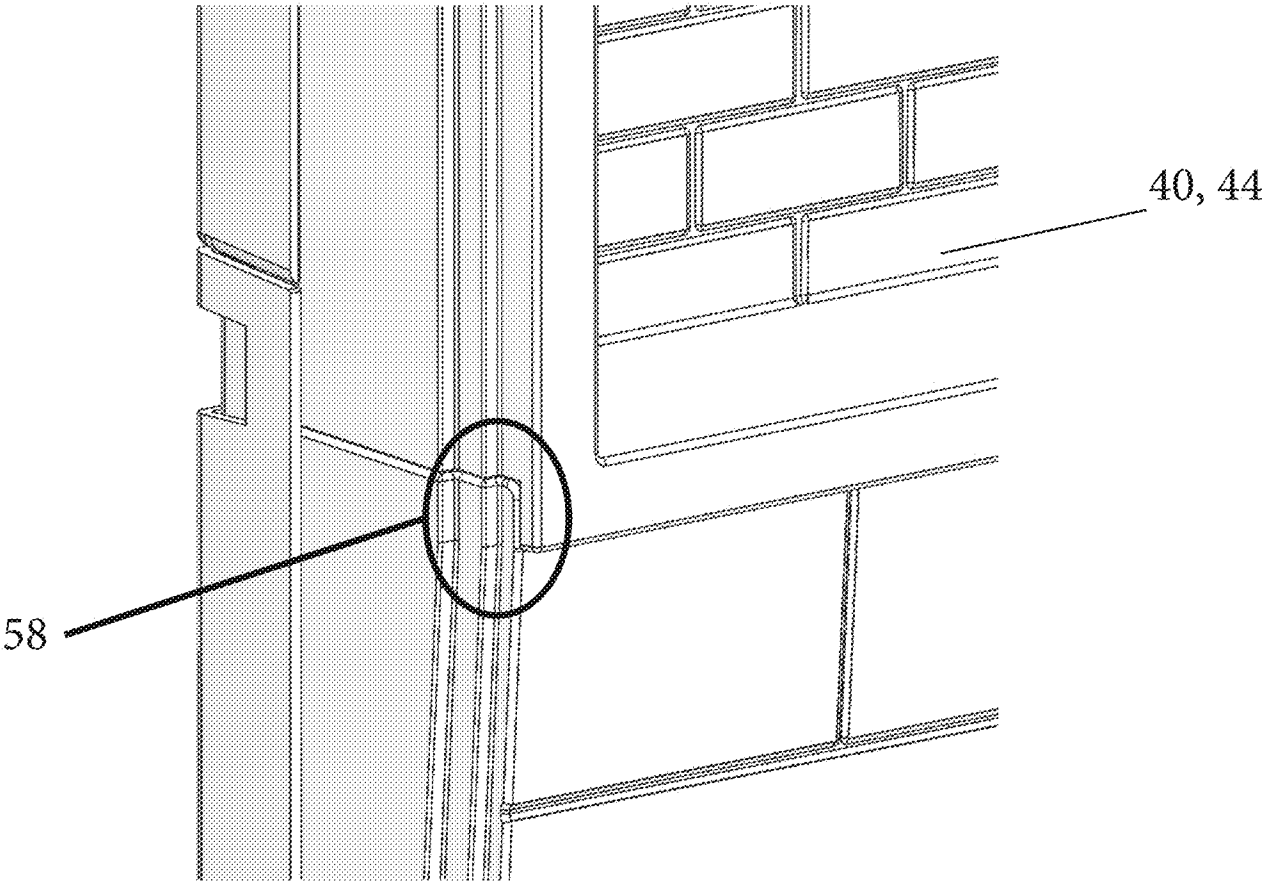
FIG. 21 is a partial perspective view of the middle of a second panel made in accordance with the current disclosure.
Figure 23:
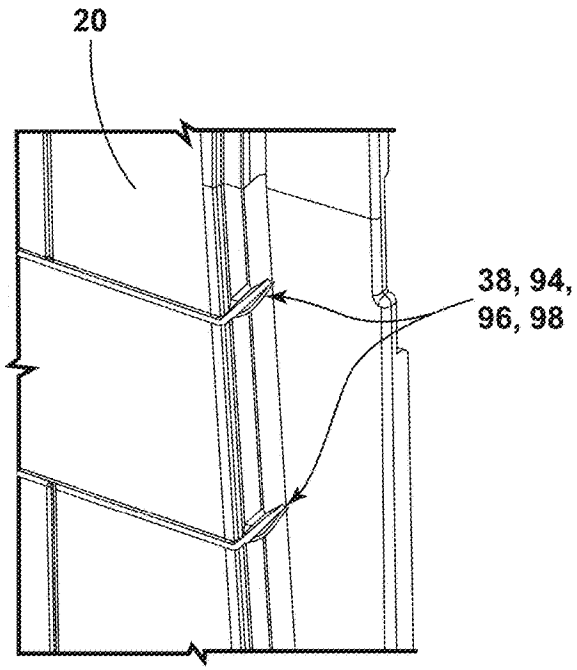
FIG. 23 is a detailed view of inset 23-23 from FIG. 22.
Figure 22:
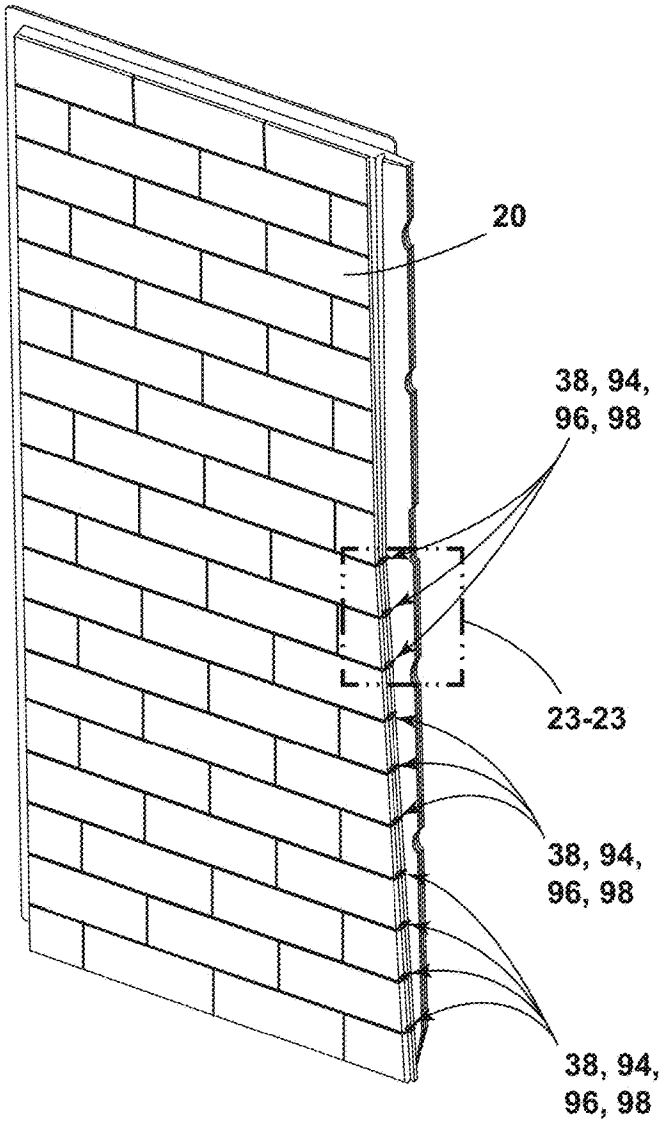
FIG. 22 a perspective view of a first panel showing a portion of the baffling system made in accordance with the current disclosure.

As seen in in FIG. 16, in one embodiment first partial channel 32 of the first panel 20 has a portion of the channel 80 while second partial panel 52 of the second panel 40 completes the channel 80. In this embodiment, the first partial channel 32 has a majority of the cross-sectional area and generally "U" shaped and the second partial panel 52 has less than a majority of the cross-sectional area and has a generally flat shape that completes the channel 80. Other, shapes and configurations of the first partial channel 32 and the second partial panel 52 are within the scope of this disclosure to complete the channel 80. The channel 80 can be shaped to direct water down toward the base 12 and the collection area 16 and correspondingly away from the walls of the building.

As seen in FIGS. 26-32, the channel 80 can vary in cross-sectional area as it approaches the base 12. In a preferred embodiment, the channel 80 narrows as it approaches the base 12. This narrowing facilitates the movement of non-water showering fluids, e.g. shampoo and soap, produced during showering.

A second feature of the shower unit 10 that can be formed by the connection of the first panel 20 and the second panel 40 is a baffling system 90. The baffling system 90 can be formed by one of more baffling areas 92. Each baffling area 92 is formed by the interaction of a first baffling section 38 on the first panel 20 and a second baffling section 58 on the second panel 40. In a preferred embodiment, the baffling system 90 includes baffling areas 92 spaced along the first height 26 and second height 46.

Figure 25:
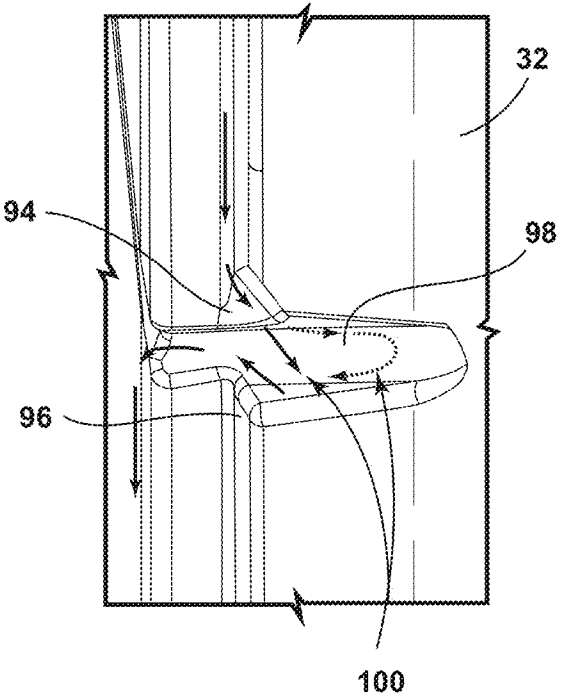
FIG. 25 is a further detailed view of portion of the baffling system.
Figure 24:
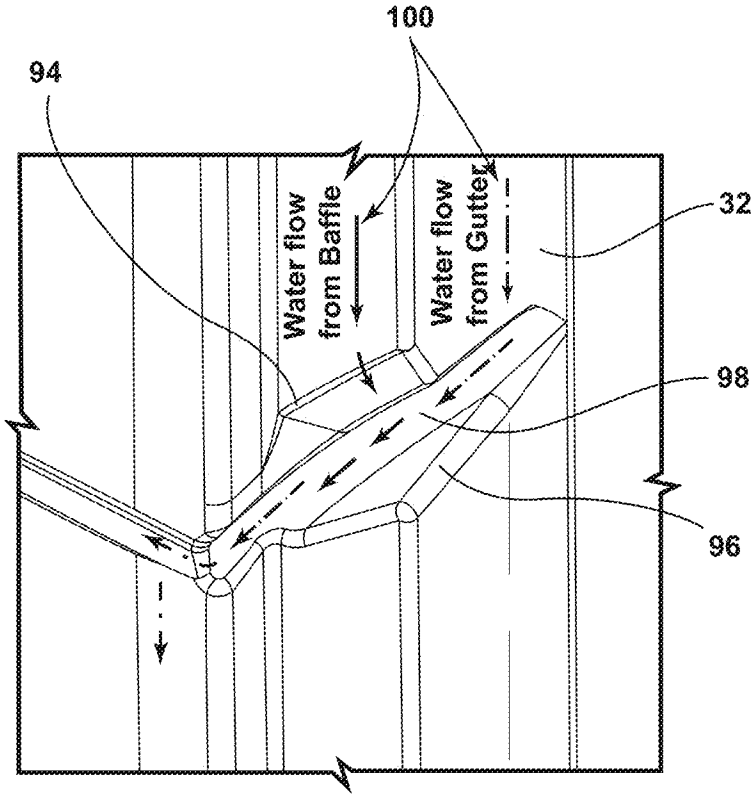
FIG. 24 is a further detailed view of portion of the baffling system.
Figure 26:
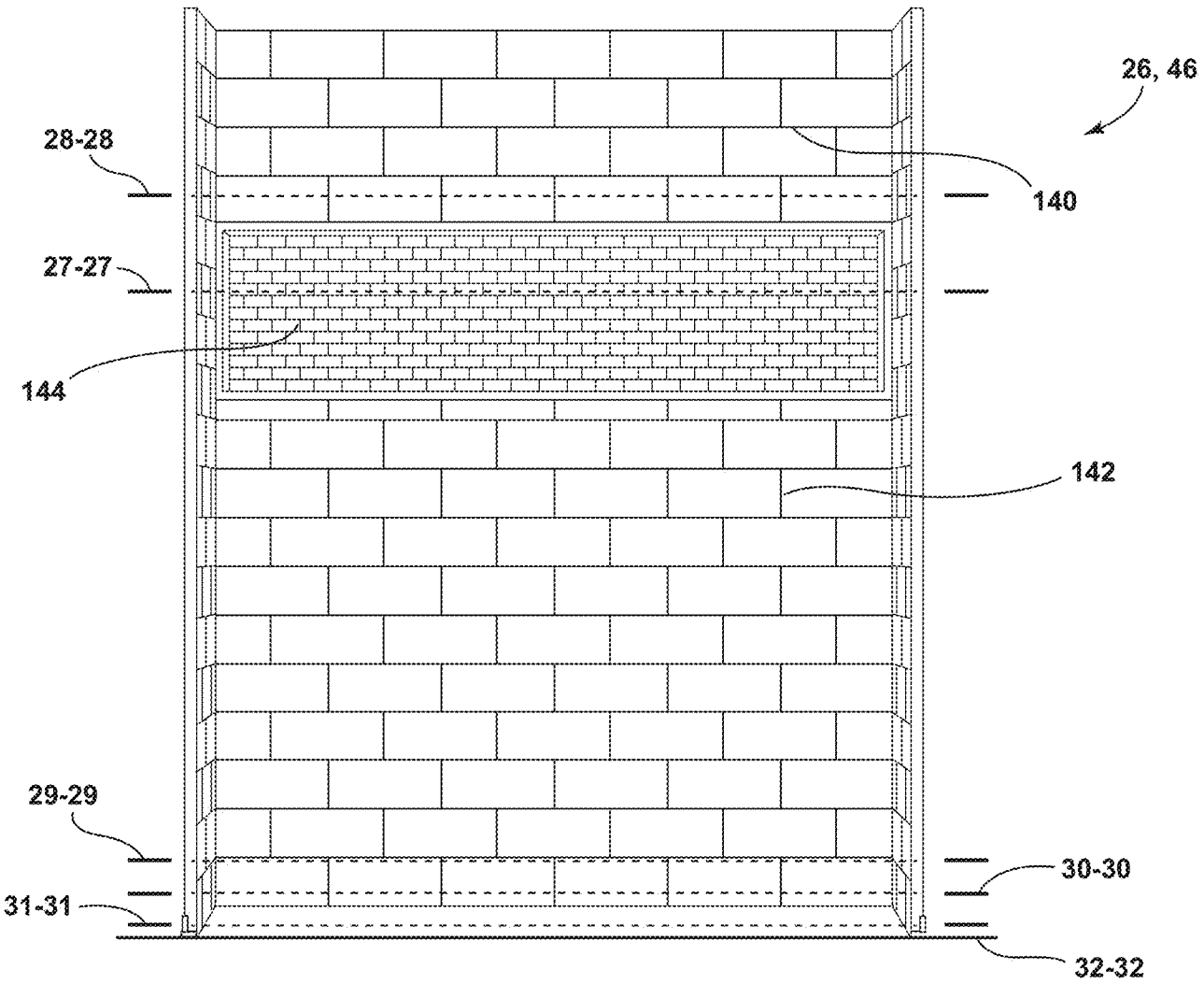
FIG. 26 is a front perspective view of a shower unit made in accordance with the current disclosure.
Figure 27:
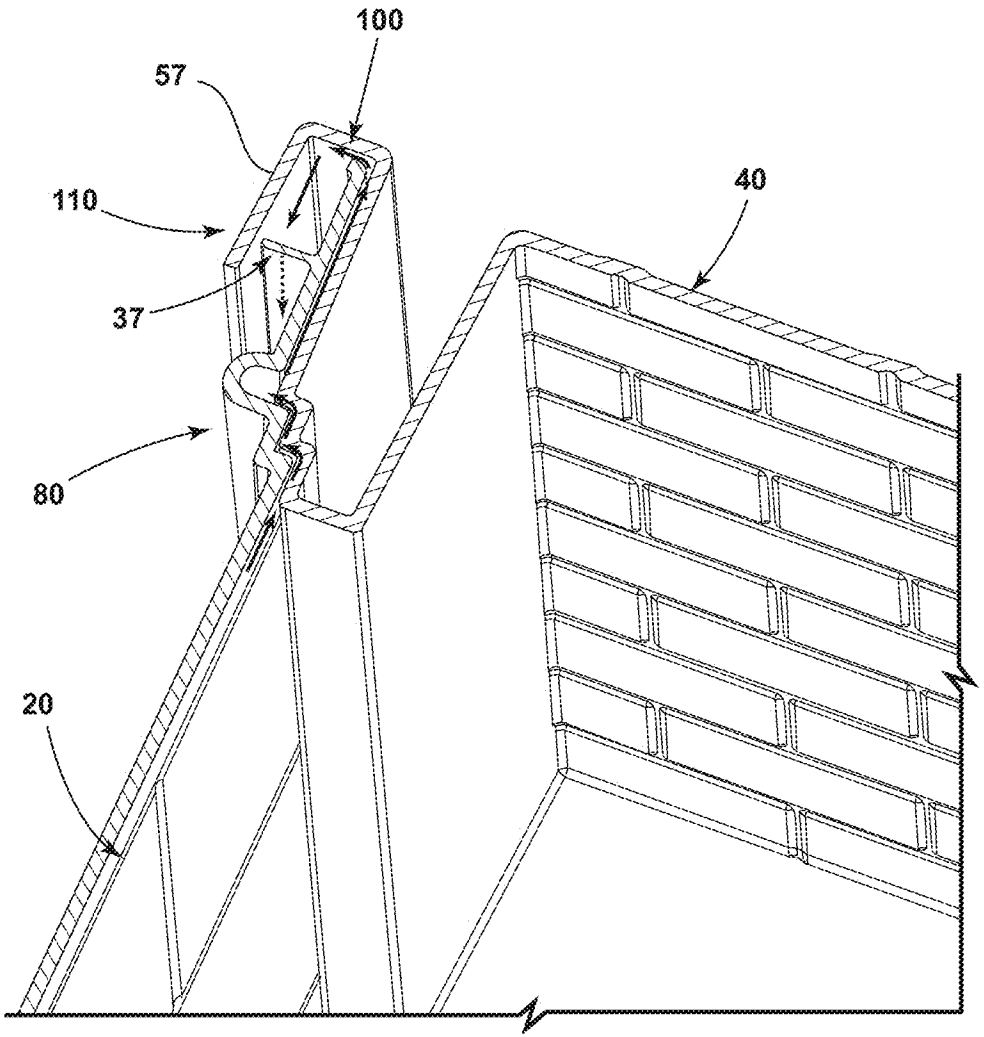
FIG. 27 is a cross section view taking along line 27-27 in FIG. 26.
Figure 28:
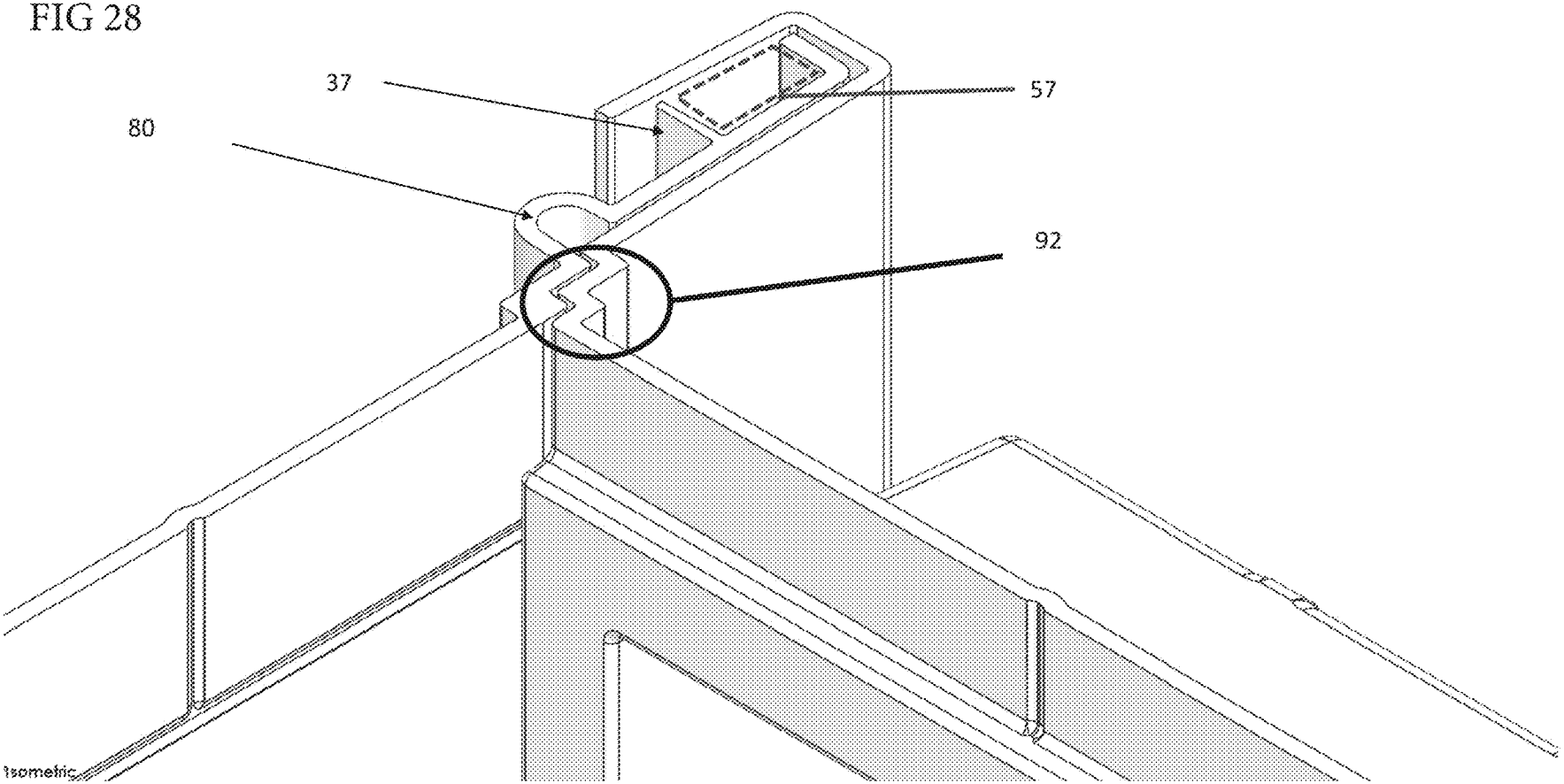
FIG. 28 is a cross section view taking along line 28-28 in FIG. 26.
Figure 29:
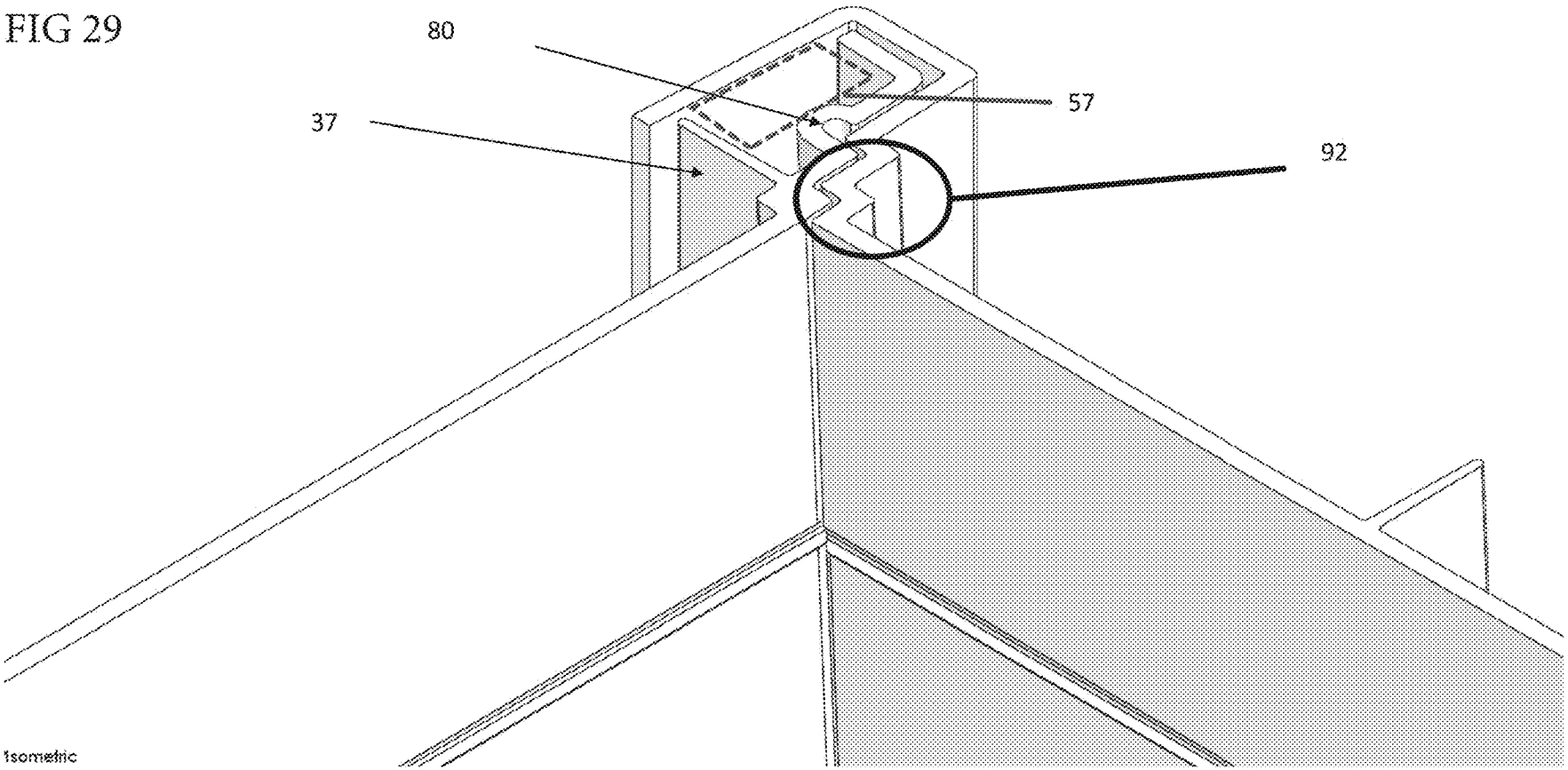
FIG. 29 is a cross section view taking along line 29-29 in FIG. 26.
Figure 30:
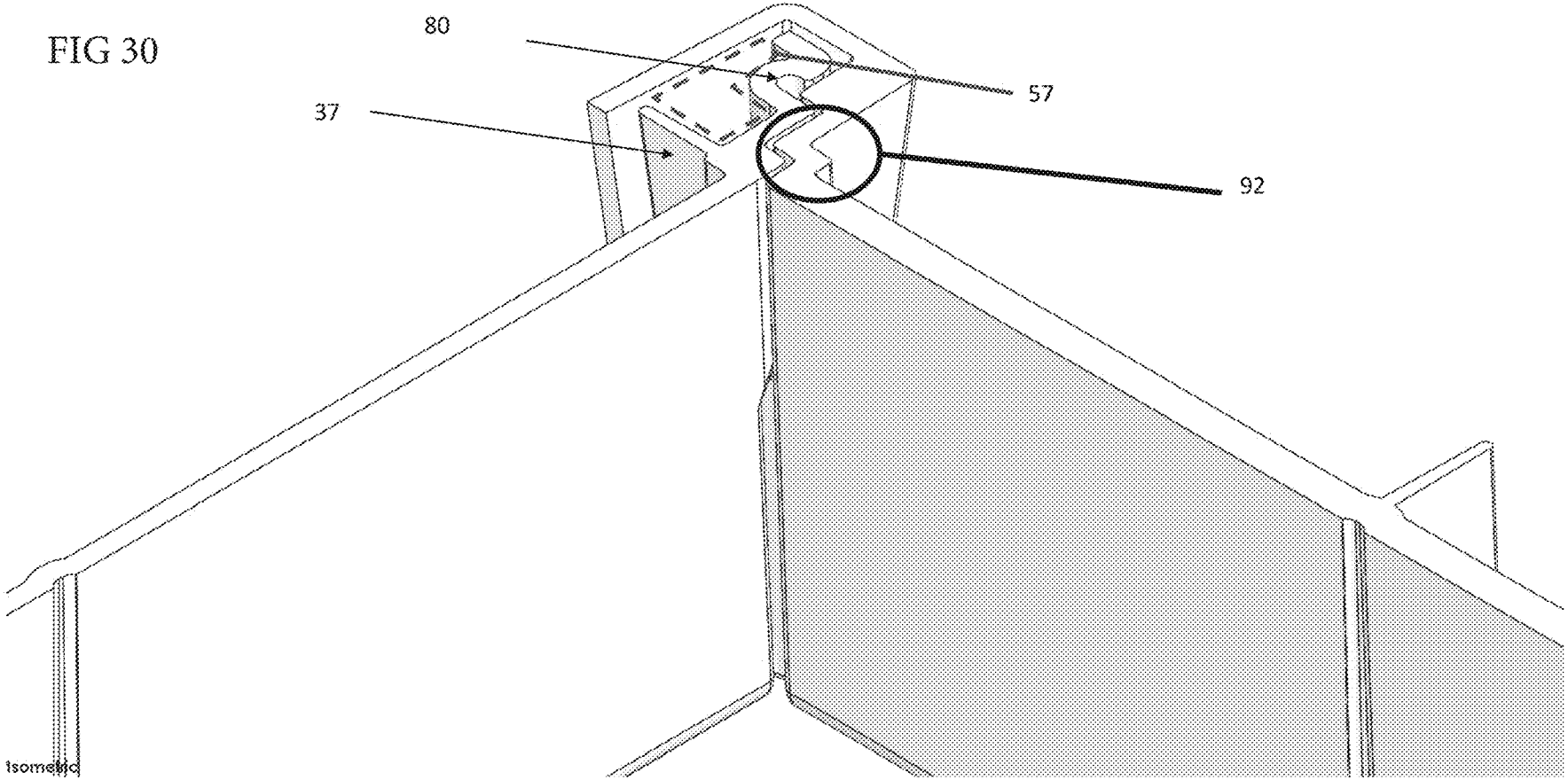
FIG. 30 is a cross section view taking along line 30-30 in FIG. 26.
Figure 31:
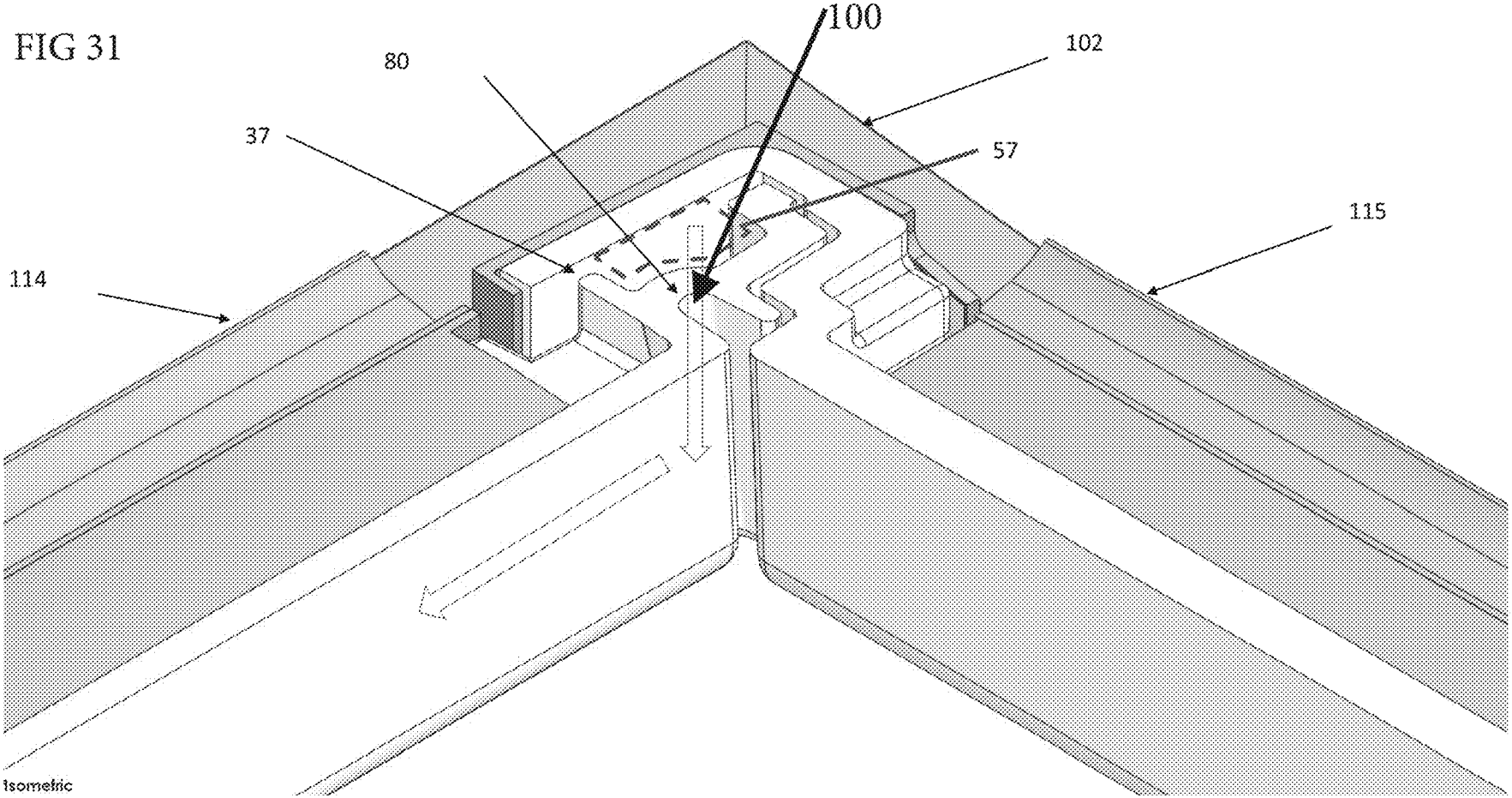
FIG. 31 is a cross section view taking along line 31-31 in FIG. 26.

The first and second baffling sections 38 and 58 include angled surfaces 94 and 96 positioned to direct fluid toward the exposed sides 24 or 44, as shown in FIGS. 24 and 25. The angled surfaces 94 and 96 redirect the fluid 100 as gravity pulls the fluid 100 down the exposed sides 24 or 44 or within the channel 80. Additionally, the angled surfaces 94 and 96, by their offset angles minimizes the volume of fluid that can enter between the panels 20 and 40.

In one preferred embodiment, the channel 80 and the baffling system 90 are both included and work in combination. The channel 80 is positioned proximate the baffling areas 92. Further, combined interaction is facilitated by a connective surface 98 positioned to connect the channel 80 and the baffling areas 92. During operation the channel 80 directs a portion of the fluid downward toward the base and a portion to the connective surface 98. The angled surfaces 94 and 96 then direct that fluid 100 outward to the exposed sides 24 and 44. In an embodiment, connective surface 98 can be a declined surface 98 positioned between the first angled surface 94 and the second angled surface 96. The declined surface 94 can extend from the channel 80 towards the exposed surface 24 of the first panel 20. The first angled surface 94 can be positioned adjacent to the declined surface 98 to direct fluid toward the declined surface 98. The second angled surface 96 can be positioned opposite the first angled surface 96 to direct fluid 100 toward the declined surface 98. This directs the fluid 100 back toward the showering area and then down the exposed surfaces 24 or 44.

A third feature of the shower unit 10 that can be formed by the connection of the first panel 20 and the second panel 40 is a retention cavity system 110. As seen in FIGS. 9, 13, and 16-19, the retention cavity system 110 can be formed by the interaction of a vertical barrier 37 on the first panel 20 and a cavity 57 on the second panel 40. The vertical barrier 37 extends a majority of the first height 26 while the cavity 57 that extends a majority of the second height 46. The vertical barrier 37 and the cavity 57 form the retention cavity system 110 when the first panel 20 is attached to the second panel 40.

Figure 10:
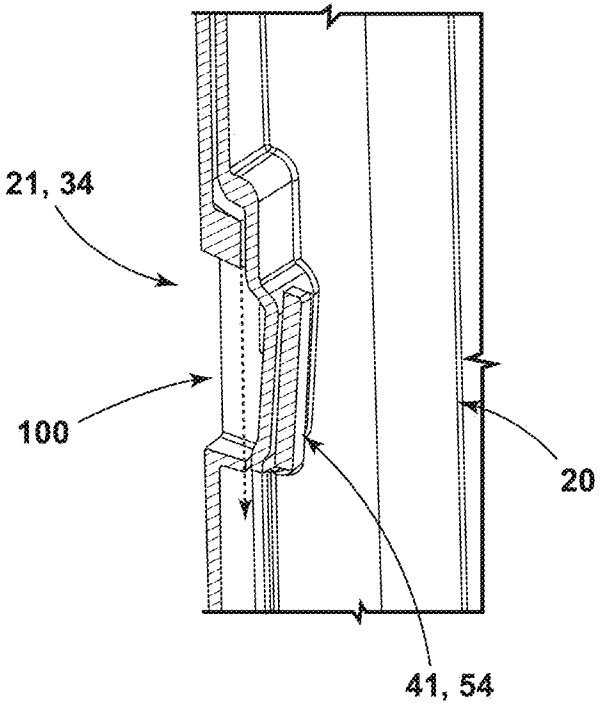
FIG. 10 is a detailed view of inset 10-10 from FIG. 9.
Figure 9:
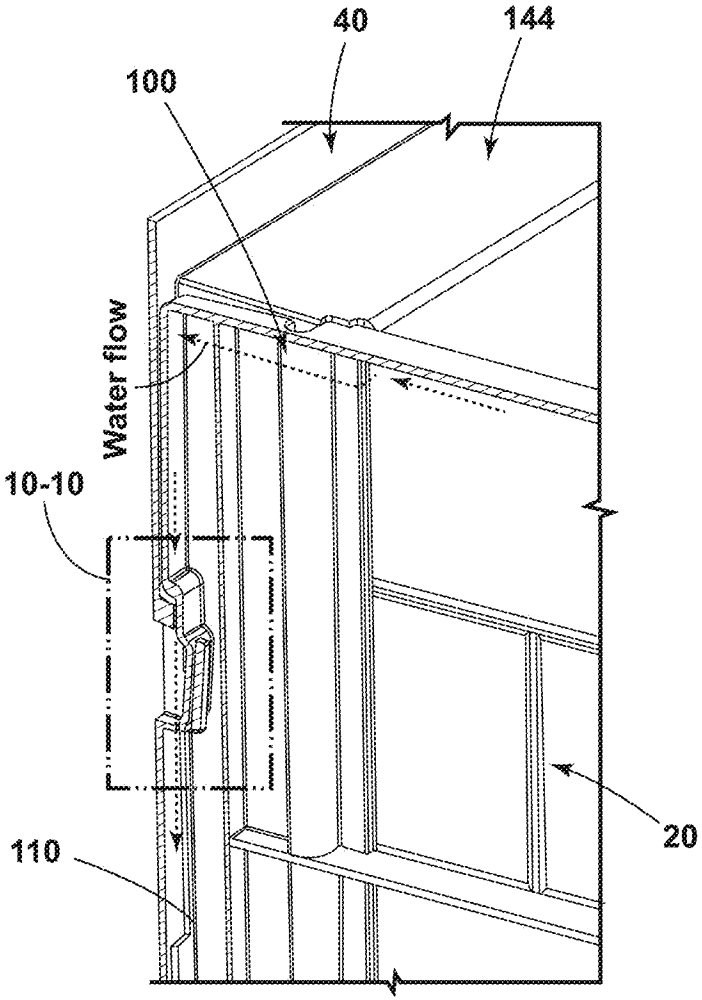
FIG. 9 is an assembled view similar to FIG. 8 showing the movement of fluid through the retention cavity system and within the interlocking members.
Figure 12:
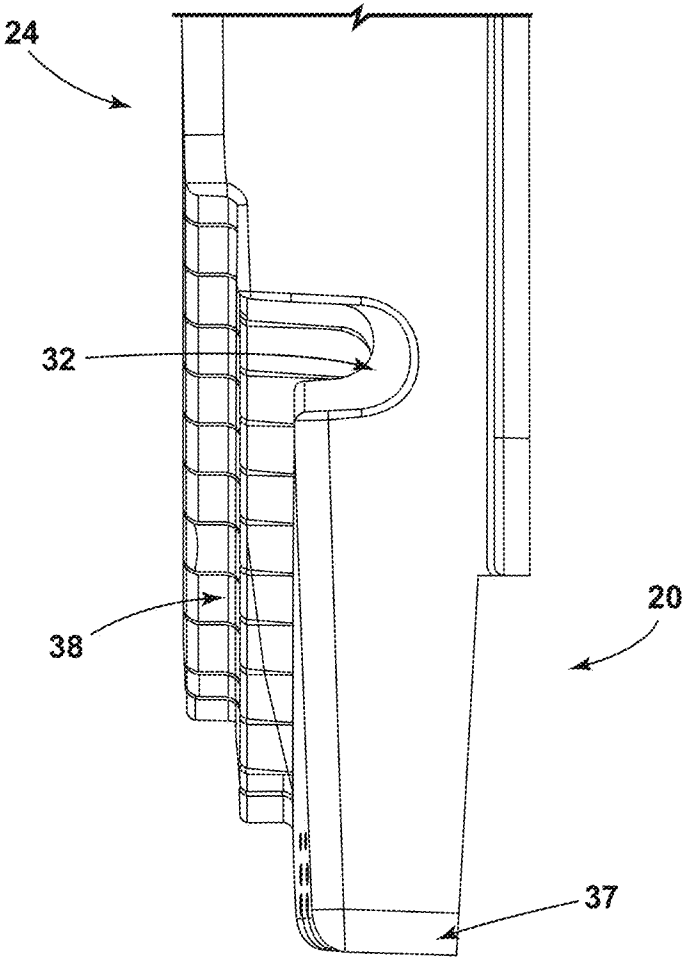
FIG. 12 is top view of the panel showing in FIG. 11.
Figure 11:
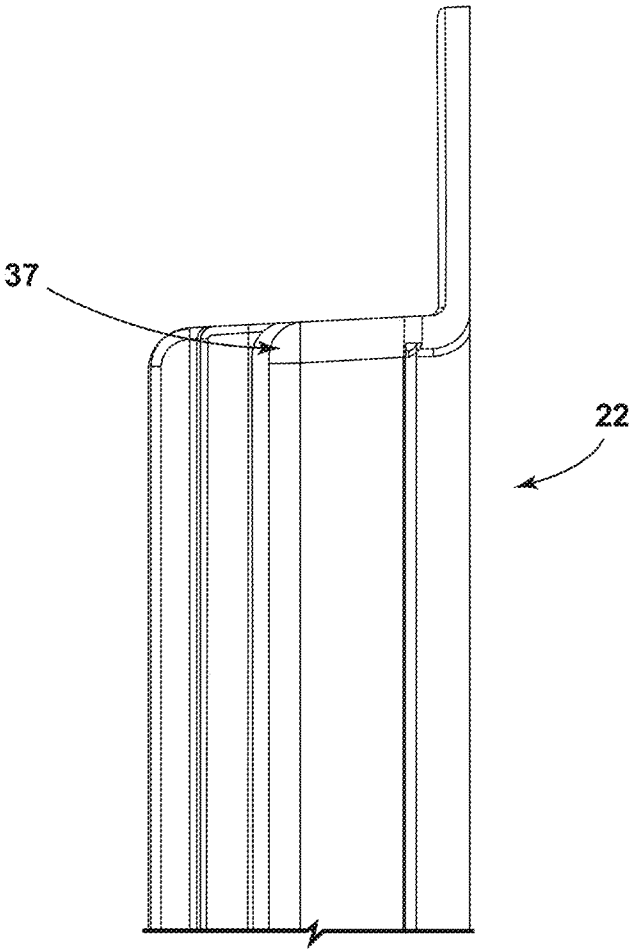
FIG. 11 is a back view of the top of portion of a first panel made in accordance with the current disclosure
Figure 13:
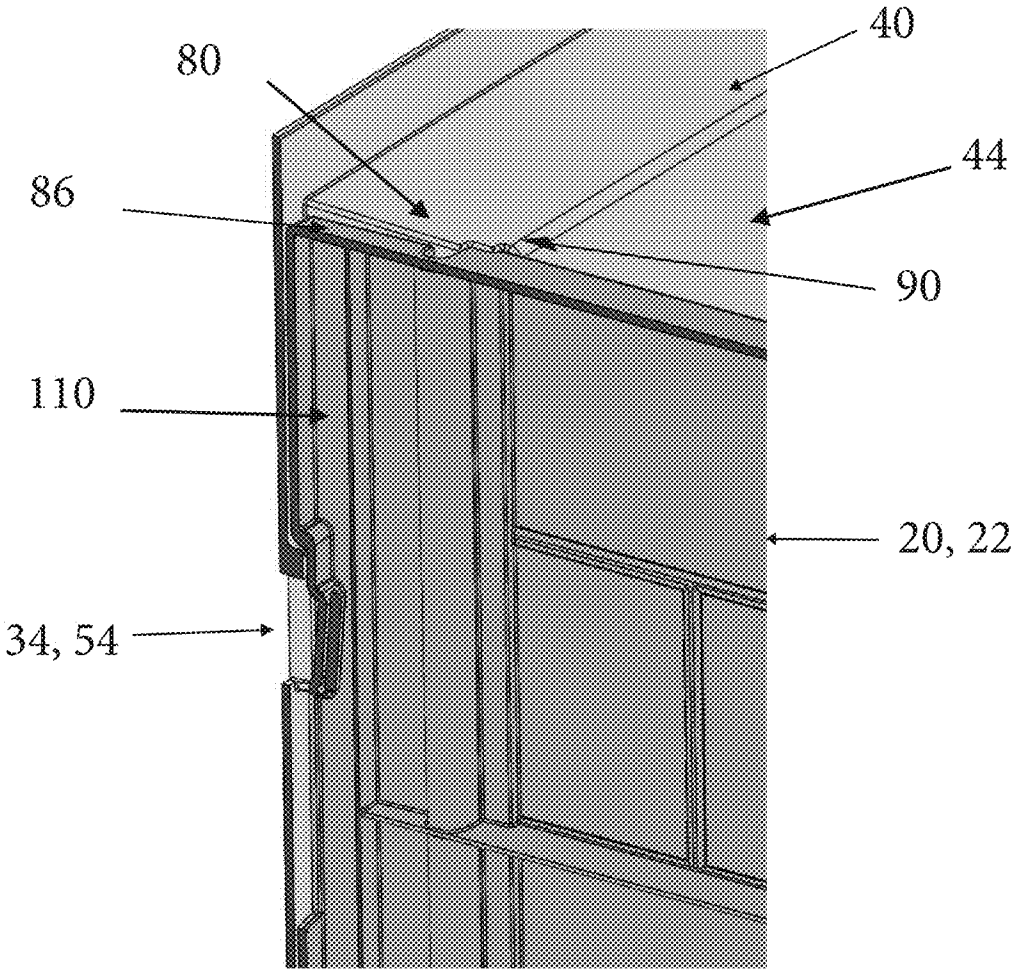
FIG. 13 is an assembled view similar to FIG. 9.
Figure 14:
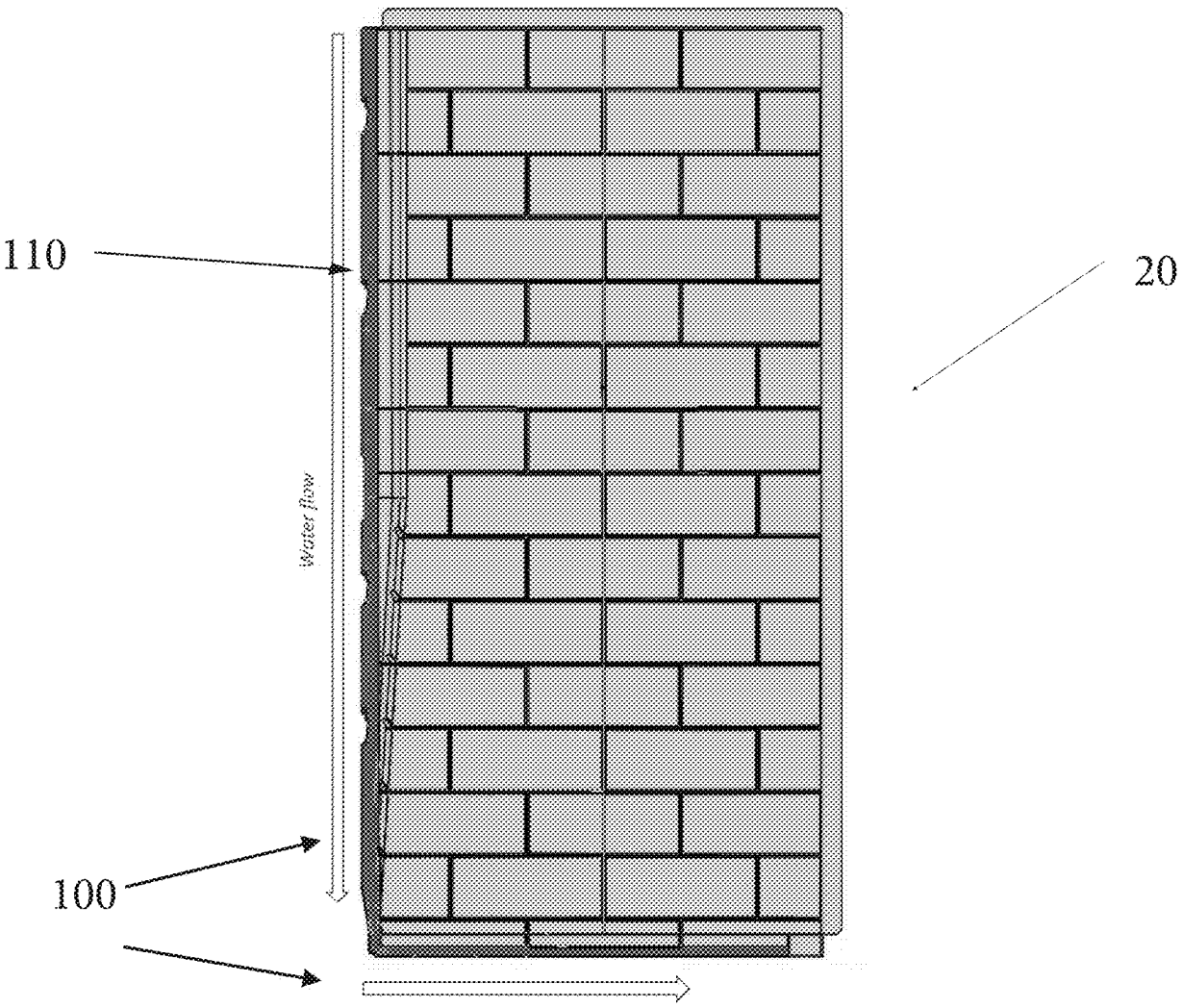
FIG. 14 is a side view of a first panel showing the movement of fluid through the retention cavity system and to the base.
Figure 15:
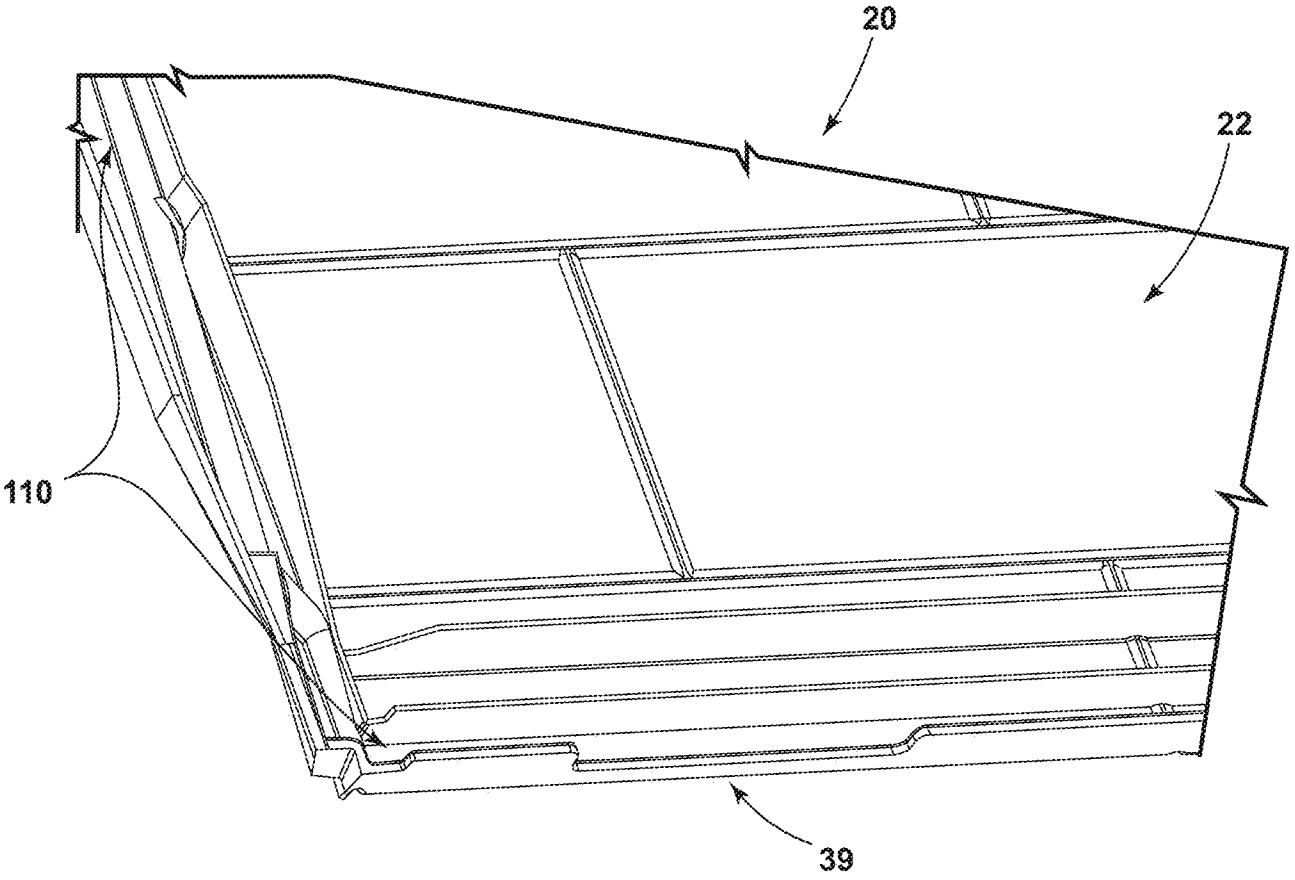
FIG. 15 is a detailed view of the corner of the first panel showing the location of the retention cavity system, channel, and a gap in the bottom of the first panel.
Figure 32:
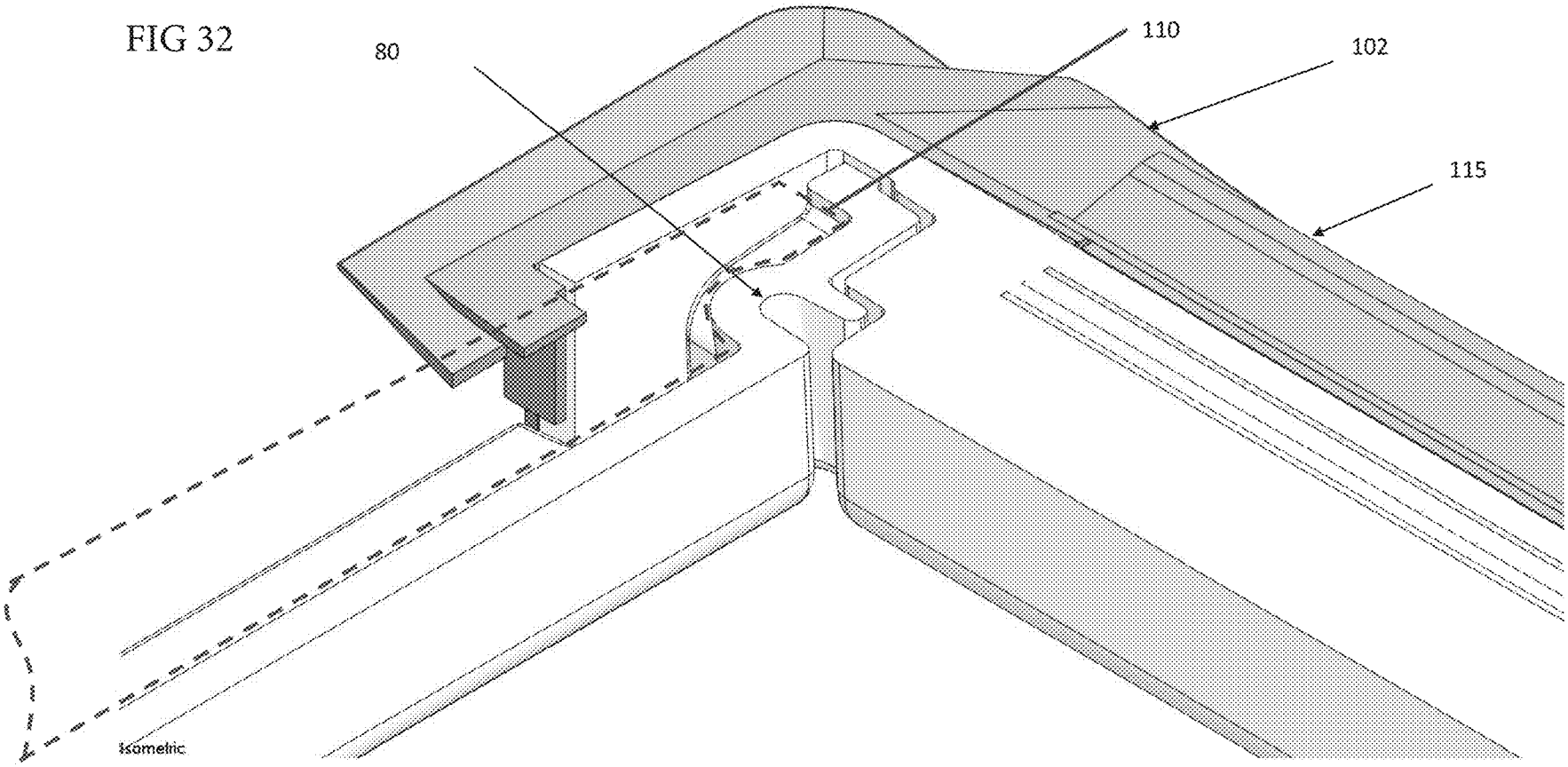
FIG. 32 is a cross section view taking along line 32-32 in FIG. 26.
Figure 33:
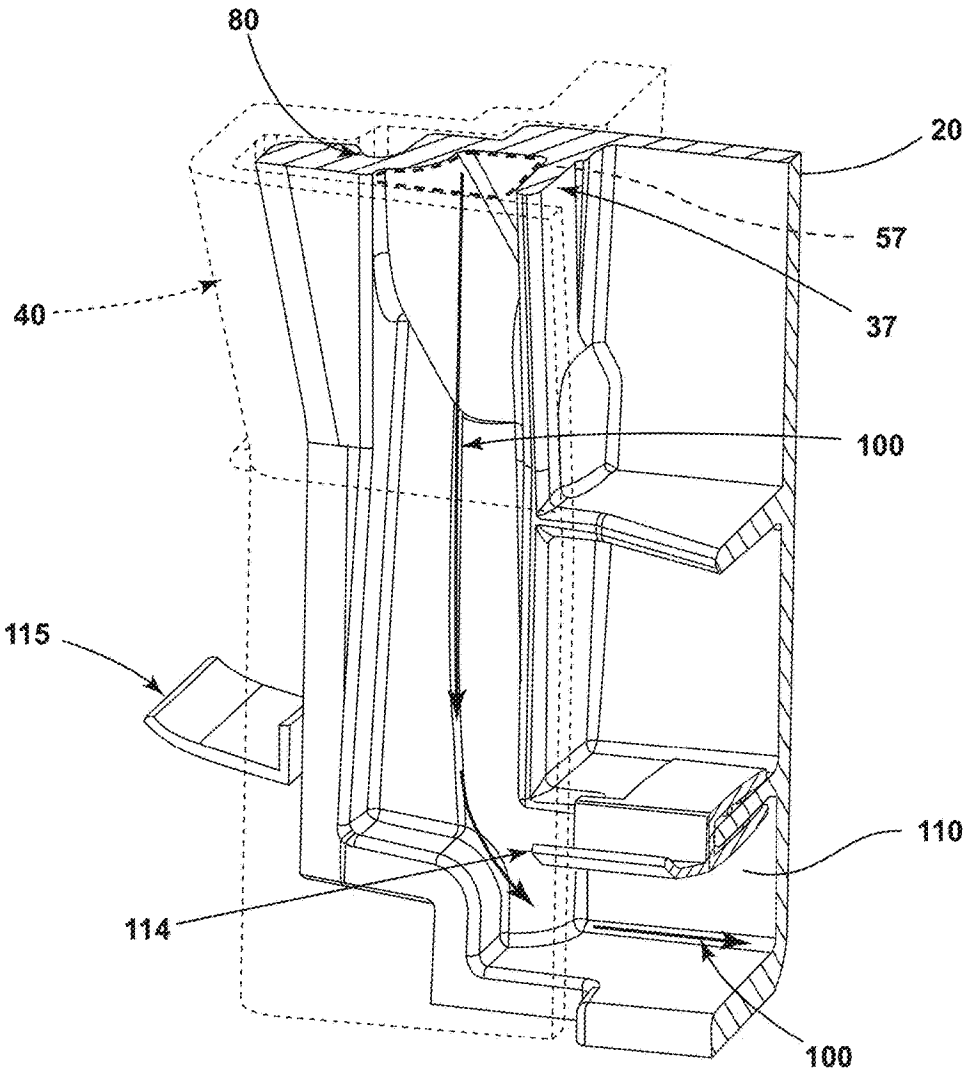
FIG. 33 is a diametric view of the bottom corner showing the connection of the first and second panels.
Figure 34:
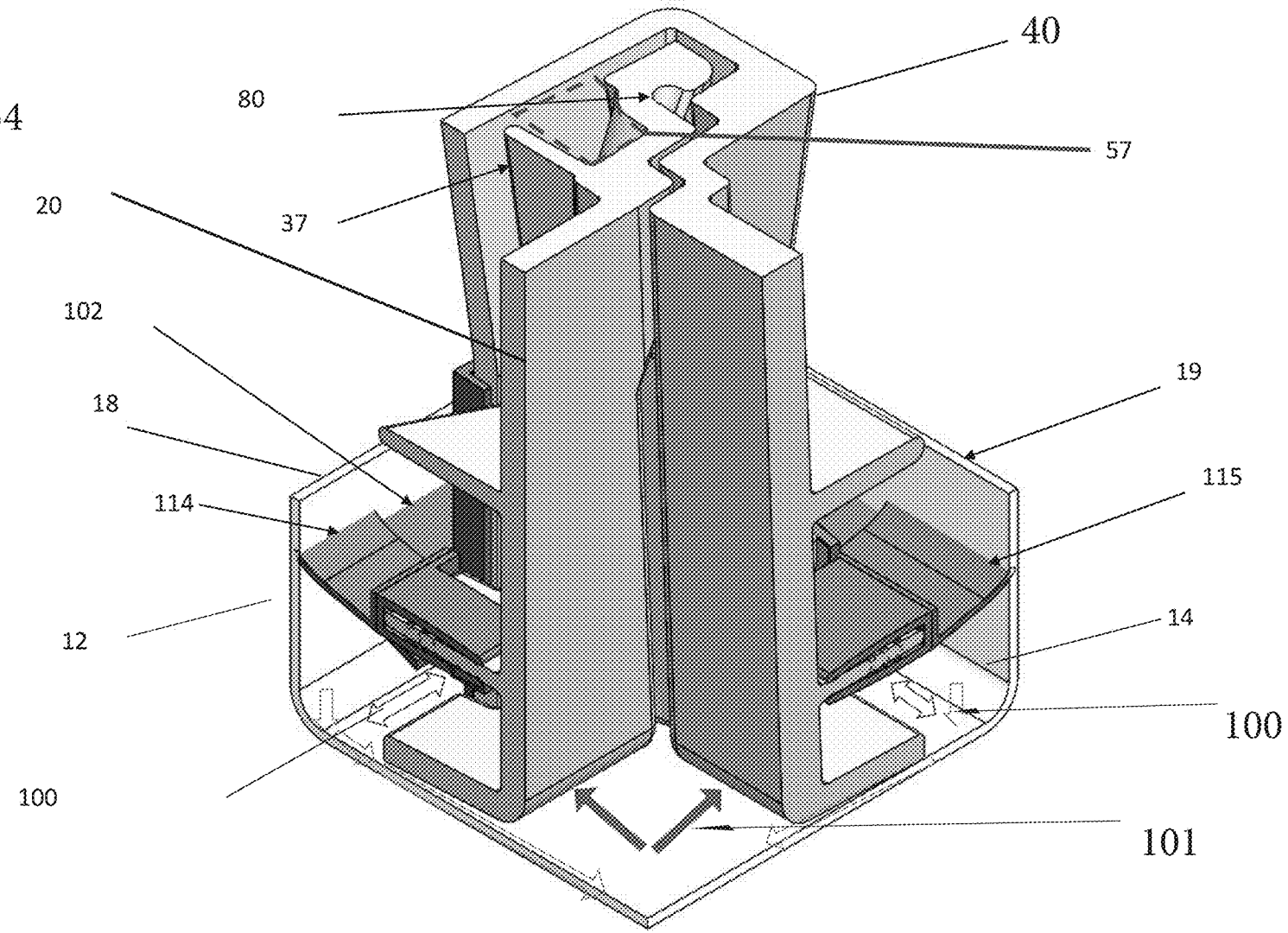
FIG. 34 is an isometric view of the bottom corner showing the connection of the first and second panels.
Figure 36A:
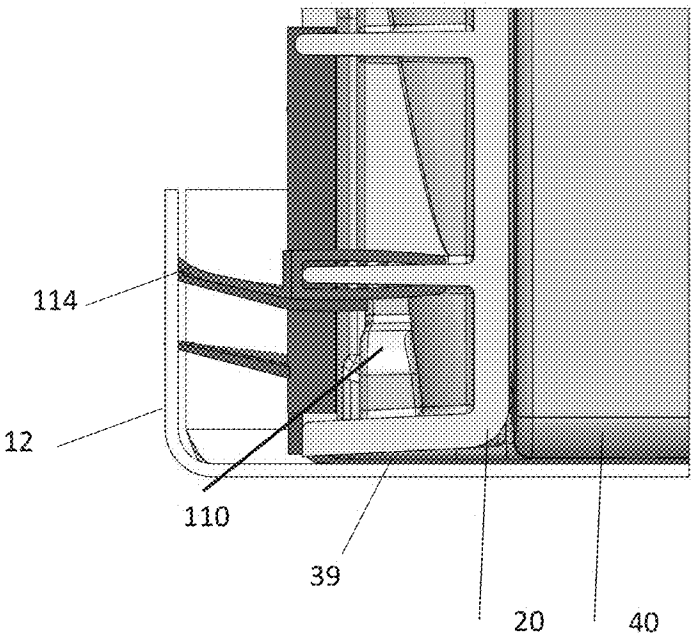
FIG. 36A is a front cross section view of the bottom corner showing the connection of the first and second panels and the gaskets.
Figure 35:
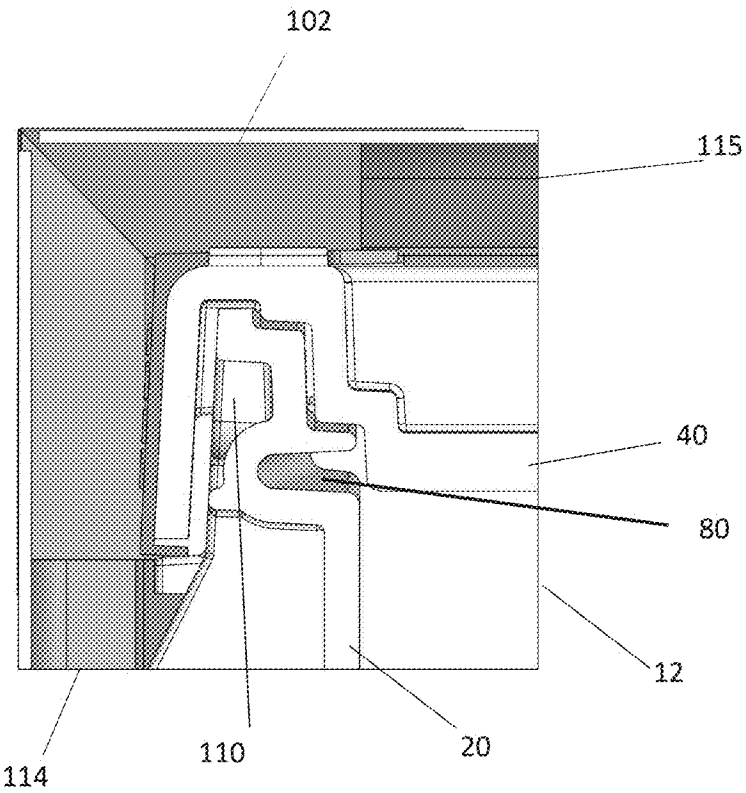
FIG. 35 is a top cross section view of the bottom corner showing the connection of the first and second panels and the gaskets.
Figure 36C:
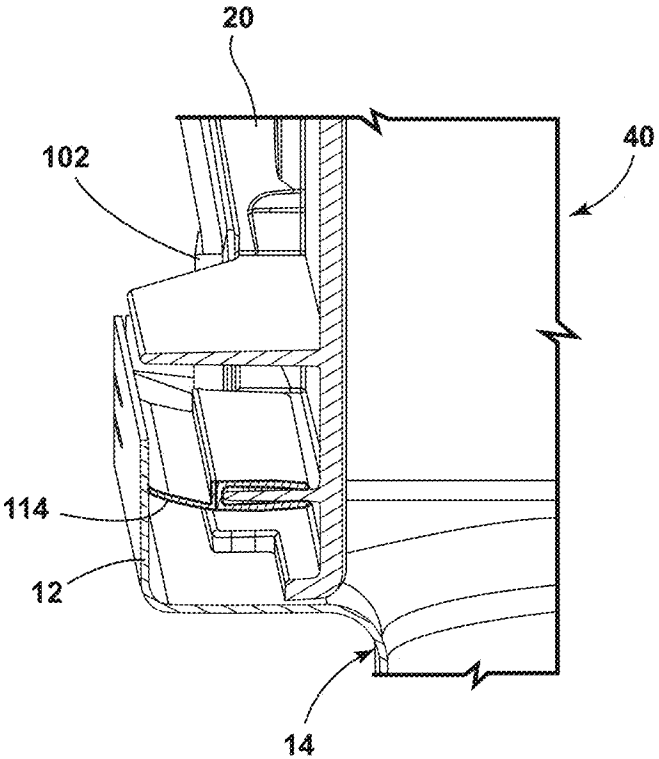
FIG. 36C is an alternate front cross section view of the bottom corner showing the connection of the first and second panels and the gaskets.
Figure 36B:
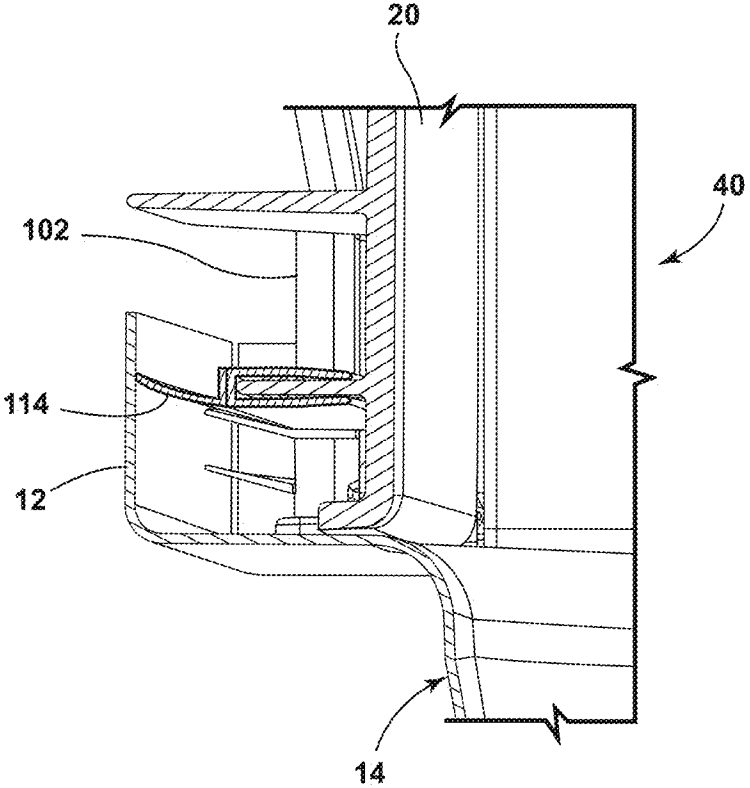
FIG. 36B is an alternate front cross section view of the bottom corner showing the connection of the first and second panels and the gaskets.
Figure 38:
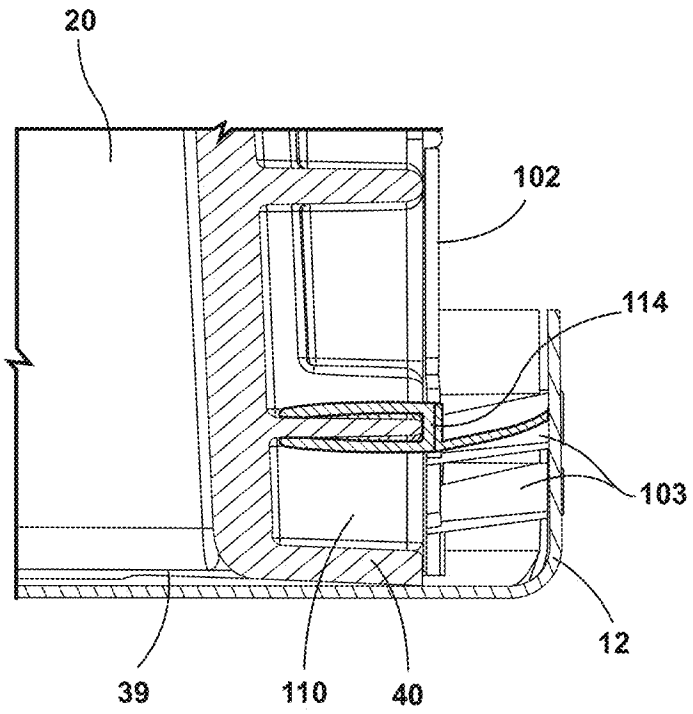
FIG. 38 is a right cross section view of the bottom corner showing the connection of the first and second panels.
Figure 37:
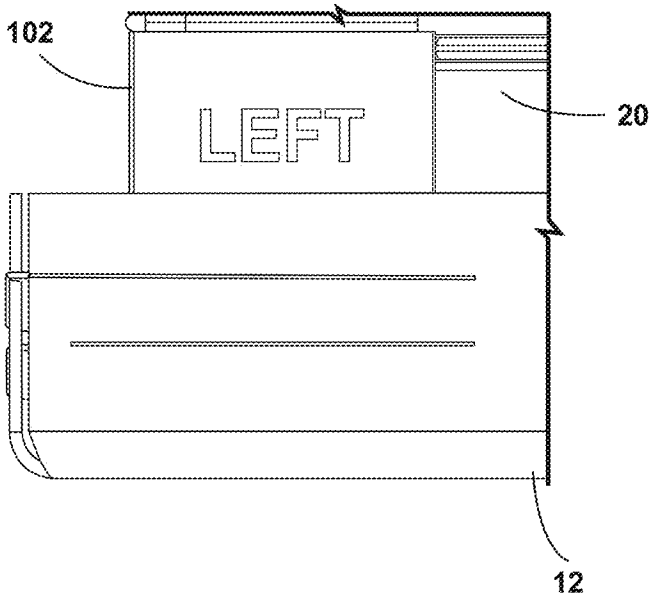
FIG. 37 is a left cross section view of the bottom corner showing the connection of the first and second panels.
Figure 39:
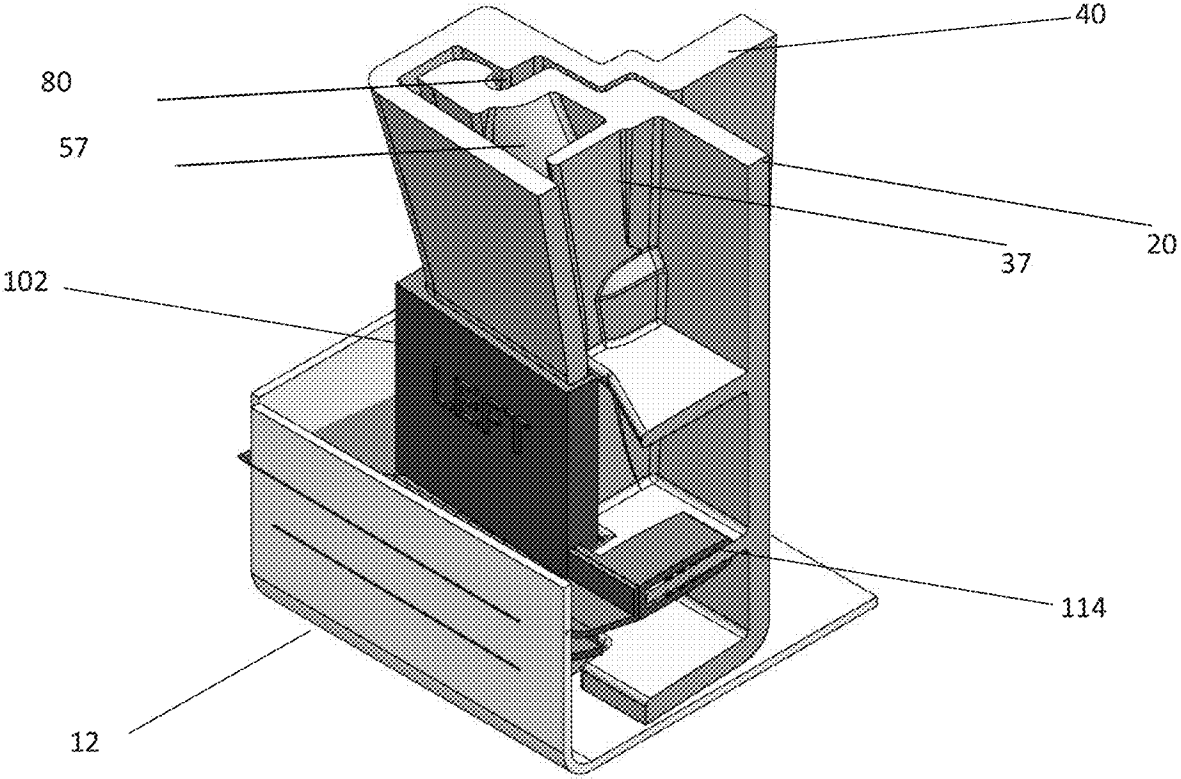
FIG. 39 is an isometric view similar to FIG. 34 of the bottom corner showing the connection of the first and second panels.
Figure 41:
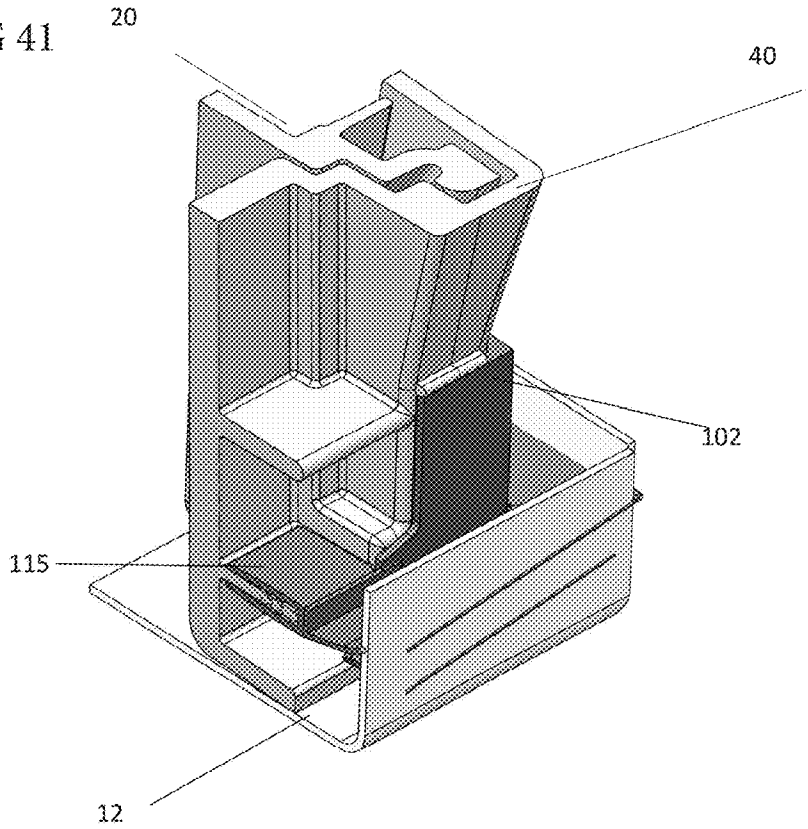
FIG. 41 is an isometric view similar to FIGS. 39-40 of the bottom corner showing the connection of the first and second panels.
Figure 40:
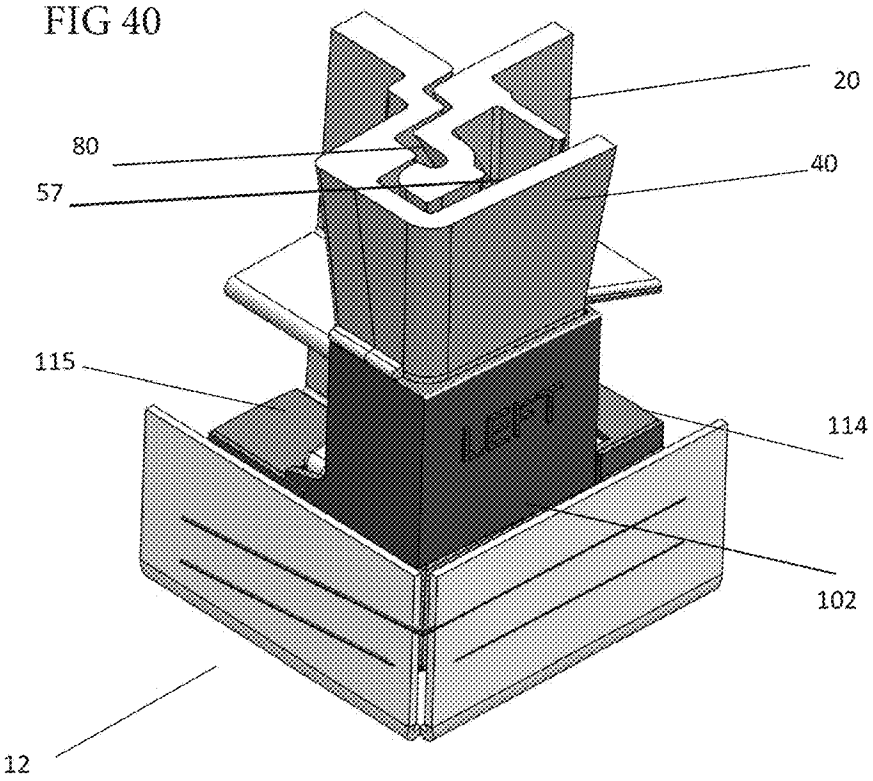
FIG. 40 is an isometric view similar to FIG. 39 of the bottom corner showing the connection of the first and second panels.
Figure 42:
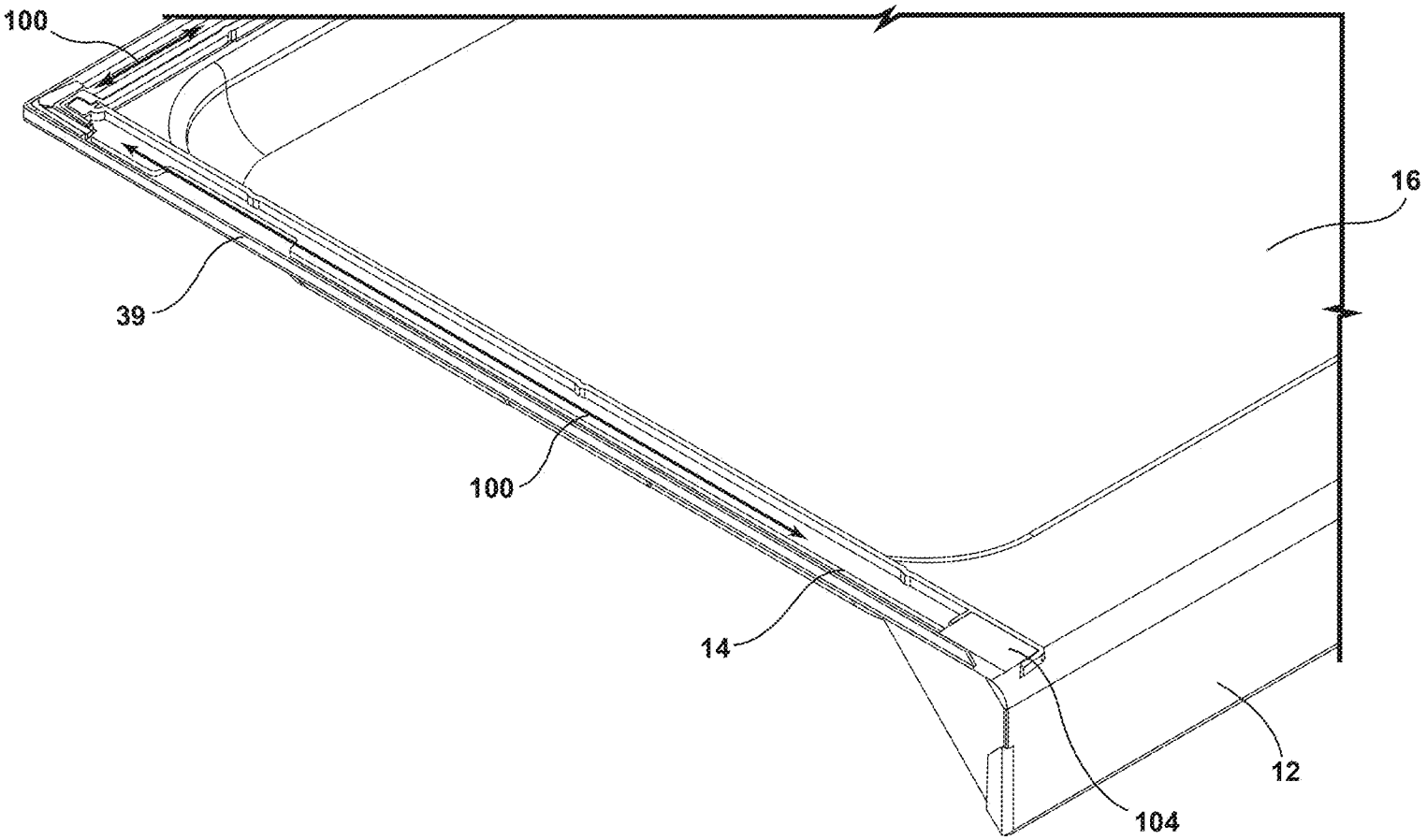
FIG. 42 is an isometric view of the base showing the trough and flow of fluid.
Figure 44:
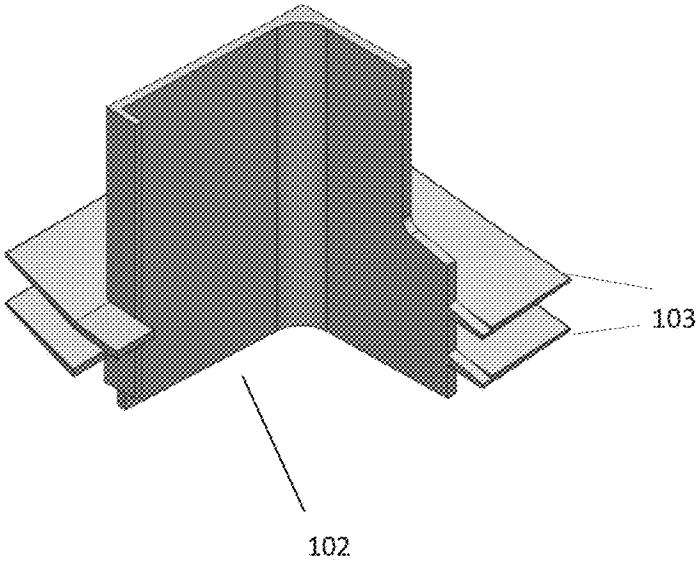
FIG. 44 is another isometric view of a corner gasket.
Figure 43:
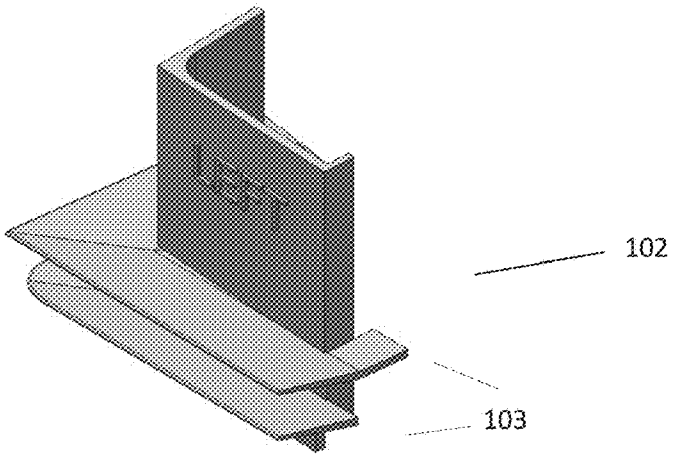
FIG. 43 is an isometric view of a corner gasket.
Figure 46:
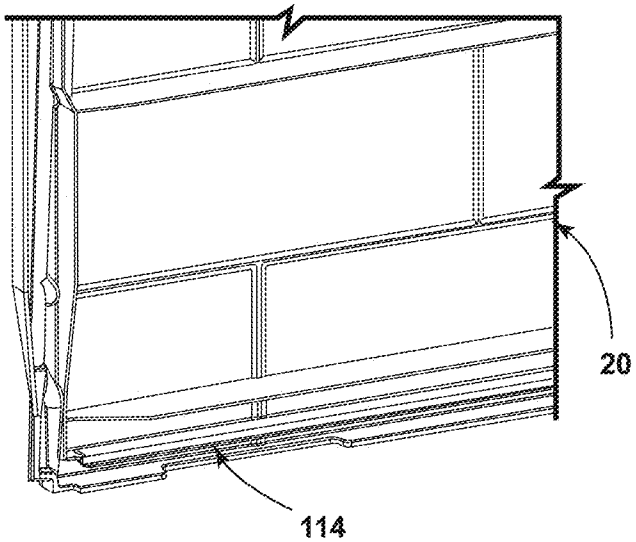
FIG. 46 is a partial view of the bottom of a first showing the sealing strip.
Figure 45:
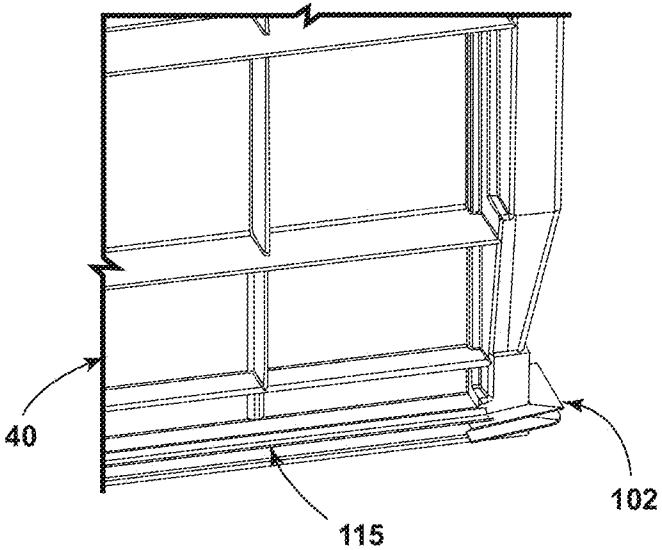
FIG. 45 is a partial view of the bottom corner showing the corner gasket and sealing strips.
Figure 48:
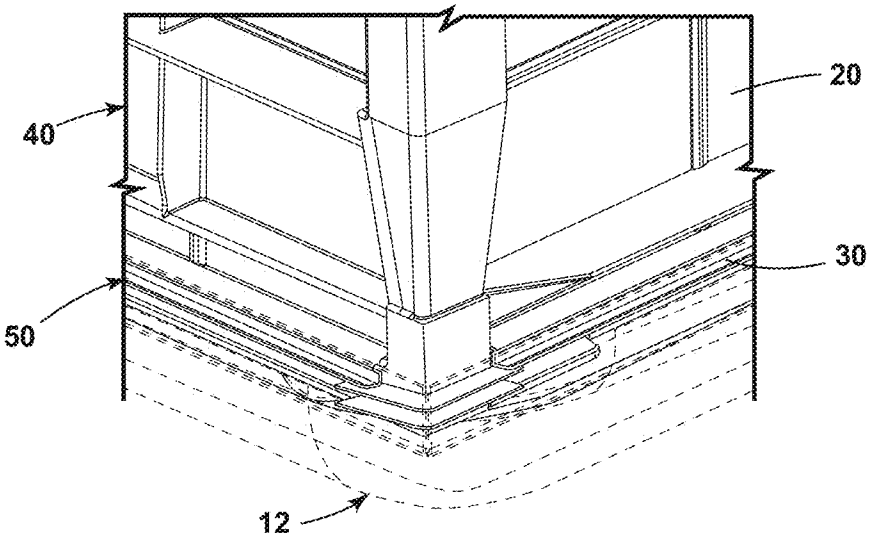
FIG. 48 is a partial view of the bottom corner showing the connection of the first panel, second panel, and base.
Figure 47:
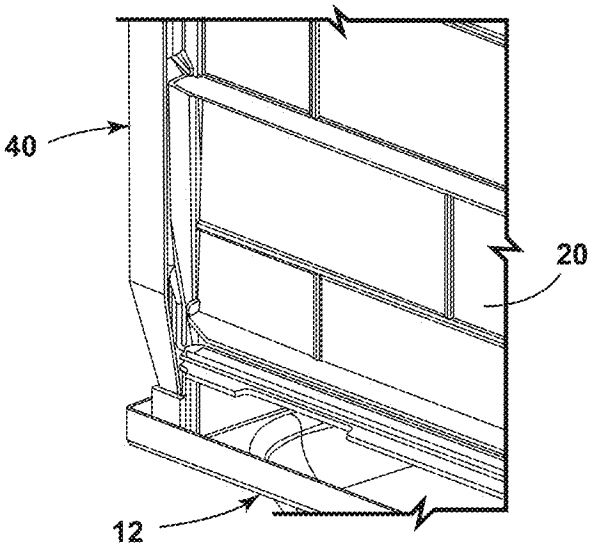

As best seen in FIGS. 32-34, the retention cavity system 110 extends vertically through the connection of the first panel attaching side 28 and the second panel attaching side 48. This allows any fluid 100 to reach the base 12, as further described below. As best seen in FIGS. 9, 10 and 14, the retention cavity system 110 extends through the first interlocking member 34 and the second interlocking member 54 when the first panel 20 is attached to the second panel 40. This allows the fluid 100 to flow through the connection and to the base 12.

In one preferred embodiment, the channel 80 and the retention cavity system 110 are both included and in combination. The channel 80 operates as described above and the retention cavity system 110 collects and fluid 100 that travels past the channel 80 and directs that fluid back down to the base 12 as described above. In this embodiment, the channel 80 is positioned between the retention cavity system 110 and the exposed sides 24 and 44 of the panels 20 and 40. In another embodiment, the channel 80, the baffling system 90, and the retention cavity system 110 are all features of the shower 10 and work in combination to collect and direct fluid toward the base 12 as described.

In an embodiment, the shower unit 10 can include a corner gasket 102, a first gasket 104, a first sealing strip 114, and second sealing strip 115. The corner gasket 102 can be shaped to engage the first panel 20 proximate the first panel attaching side 28 and the second panel 40 proximate the second panel attaching side 48. The corner gasket can include multiple protrusions 103 to aid in the fit and seal with the base 12. As best seen in FIG. 34, the corner gasket 102 can fluidly separate the wall side 22 of the first panel 20 and the wall side 42 of the second panel 40 from the collection area 16 of the base 12. The corner gasket 102, in preferred combination with the stealing strips 114 and 115 and first gasket 104, restricts the flow of fluid 100 from the base 12 from being forced up the wall sides 22 or 42. This is especially beneficial in modern shower design that include multiple, high-pressure shower heads that can send high pressure water 101 under the bottom of the shower walls. Further, any fluid 100 that is in the retention cavity system 110 will be restricted from the wall sides 22 or 42 and pass under the first panel 20 at a gap 39, which is between the sealings strip 114 and the collection area 16 of the base 12, and into the collection area 16 of the base 12.

Alternately described, the sealing strips 114 and 115 are operatively connected to each other through the corner gasket 102 and are operatively connected to the first gasket 104. These connections can collectively form a watertight seal on the lower rear perimeter of the first panel 20 and the second panel 40. This seal can use the first edge 18 and a second edge 19, or flanges, of the base 12 to separate the wall side 22 and wall side 42 from any fluid 100 in the base 12. Alternately, described this can create a fluid closed loop that maintains the fluid 100 from the shower heads in specific areas, namely, on the exposed sides 24 and 44, in the collection area 16, in the channel 80, in the baffling system 90, or in the retention cavity system 110. This effectively keep fluid 100 from the floor and walls of the room where the shower unit 10 is located.

The first gasket 104 can be part of the first panel 20 and be positioned on the wall side 22 of the first panel 20. The first gasket 104 can be shaped to engage the trough area 14 of the base 12 to restrict the flow of fluid 100 from leaving the front on the shower. The first gasket 104, trough 14, and gap 39 directs any fluid 100 that traveled down the retention cavity system into the collections area 14.

In an embodiment of the shower unit 10, the third panel 60 can be a "mirror image of the first panel 20 and the second panel 40 can have a "mirror side" opposite the second panel attaching side 48. This allows the mirror side of the second panel 40 and the third panel 60 interact in the same way as the first and second panels interact as previously described.

In an embodiment of the shower unit 10, the second panel 40 can be comprised of two sections, a top section 140, and a bottom section 142. The top section 140 can include a seat 147 that mates with a connector 148 in the bottom section 142. The seat 147 and connector 148 can be shaped to frictionally engage each other and keep the bottom section 142 attached to the top section 140. Additionally, the top section 140 can have an inset 144 that provides a location for a user of the shower unit 10 to place items, such as personal cleaning products and devices. Preferably the top section 140 has this inset 144, but alternately the inset 144 can be positioned in the bottom section 142 if desired.

Thus, it is seen that the apparatus and methods disclosed herein achieve the ends and advantages previously mentioned. Numerous changes in the arrangement and construction of the parts and steps will be readily apparent to those skilled in the art and are encompassed within the scope and spirit of the present disclosure.

What is claimed is:

1. A shower unit for placement proximate to one or more walls of a building comprising:

a base including a length, a width, a collection area, a first edge, and a second edge a first panel including a wall side, an exposed side, a first height, a first panel attaching side, a first base end, and a first partial channel, the first base end shaped to engage the first edge of the base, the first panel attaching side including a first interlocking member;

a second panel including a wall side, an exposed side, a second height approximately equal the first height, a second panel attaching side, a second base end, and a second partial channel, the second base end shaped to engage the second edge of the base, the second panel attaching side including a second interlocking member shaped to accept the first interlocking member and secure the first panel attaching side to the second panel attaching side; and wherein when the first panel is attached to the second panel the first partial channel and the second partial channel form a channel extending substantially the first height and the second height, the channel shaped to direct water down toward the base and away from the one or more walls, the channel including a cross-sectional area that varies, with the cross-sectional narrowing as the channel approaches the base, and wherein the first panel further includes at least one first baffling section positioned proximate the first partial channel and the second panel further includes at least one second baffling section positioned proximate the second partial channel, the first baffling section and the second baffling section forming a baffling area when the first panel is attached to the second panel, the baffling area positioned closer to the exposed sides of the first and second panels than the channel is to the exposed sides of the first and second panels.

2. The shower unit of claim 1, wherein:

the first partial channel is spaced from the exposed side of the first panel;

the second partial channel is spaced from the exposed side of the second panel; and the channel is shaped to direct water toward the collection area.

3. The shower unit of claim 1, wherein:

the first panel includes a plurality of first baffling sections positioned proximate the first partial channel and spaced along the first height;

the second panel includes a plurality of second baffling sections positioned proximate the second partial channel and spaced along the second height; and each first baffling section combining with one of the second baffling sections to forming a baffling area with the baffling areas forming a baffling system when the first panel is attached to the second panel.

4. The shower unit of claim 1, wherein the baffling system includes angled surfaces positioned to direct fluid from the channel to one of the exposed sides of the first panel or the second panel.

5. The shower unit of claim 4, wherein the first baffling section includes:

a declined surface extending from the channel towards the exposed surface;

a first angled surface positioned adjacent to the declined surface to direct fluid toward the declined surface;

a second angled surface positioned opposite the first angled surface to direct fluid toward the declined surface.

6. The shower unit of claim 1, further including a corner gasket shaped to engage the first panel proximate the first panel attaching side and the second panel proximate the second panel attaching side, wherein the corner gasket fluidly separates the wall side of the first panel and the wall side of the second panel from the collection area of the base.

7. The shower unit of claim 1, wherein the first panel further includes a first gasket positioned on the wall side proximate the first base end with the first gasket shaped to engage the base proximate the first edge of the base.

8. The shower unit of claim 1, wherein:

the first panel attaching side includes a vertical barrier that extends a majority of the first height;

the second panel attaching side includes a cavity that extends a majority of the second height;

the vertical barrier and the cavity form a retention cavity system when the first panel is attached to the second panel.

9. The shower unit of claim 8, wherein the channel is positioned between the retention cavity system and the exposed sides of the panels.

10. The shower unit of claim 8, wherein the retention cavity system extends to the first base end and is positioned to direct fluid under the first base end and into the collection area of the base.

11. The shower unit of claim 8, wherein the retention cavity system extends through the first interlocking member and the second interlocking member when the first panel is attached to the second panel.

12. The shower unit of claim 1, wherein the base includes a third edge;

further including a third panel including a wall side, an exposed side, a third height approximately equal to the first height, a third panel attaching side, a third base end, and a third partial channel, the third base end shaped to engage the third edge of the base, the third panel attaching side including a third interlocking member;

the second panel including a mirror panel attaching side, and a mirror partial channel, the mirror panel attaching side including a mirror interlocking member shaped to accept the third interlocking member and secure the mirror panel attaching side to the third panel attaching side.

13. A shower unit comprising:

a base including a length, a width, a collection area, a first edge, and a second edge a first panel including a wall side, an exposed side, a first height, a first panel attaching side, a first base end, and a first baffling section, the first base end shaped to engage the first edge of the base, the first panel attaching side including a first interlocking member;

a second panel including a wall side, an exposed side, a second height approximately equal the first height, a second panel attaching side, a second base end, and a second baffling section, the second base end shaped to engage the second edge of the base, the second panel attaching side including a second interlocking member shaped to accept the first interlocking member and secure the first panel attaching side to the second panel attaching side; and a channel extending substantially the first height and the second height, the channel shaped to direct water down toward the base and away from the one or more walls, the channel defined between the first panel attaching side and the second panel attaching side when the first panel is attached to the second panel, wherein the first baffling section is positioned proximate the exposed side of the first panel and the second baffling section positioned proximate the exposed side of the second panel, the first baffling section and the second baffling section forming a baffling area when the first panel is attached to the second panel, the baffling area including a declined surface extending from the channel to the exposed side of at least one of the first panel or the second panel for directing at least some of the water from the channel to the exposed sides of the first and second panels.

14. The shower unit of claim 13, wherein:

the first panel includes a plurality of first baffling sections positioned proximate the exposed side of the first panel and spaced along the first height;

the second panel includes a plurality of second baffling sections positioned proximate the exposed side of the second panel and spaced along the second height; and each first baffling section combines with one of the second baffling sections to forming a baffling area with the baffling areas forming a baffling system when the first panel is attached to the second panel.

15. The shower unit of claim 13, wherein the first baffling section includes:

a first angled surface positioned adjacent to the declined surface to direct fluid toward the declined surface; and a second angled surface positioned opposite the first angled surface to direct fluid toward the declined surface.

16. The shower unit of claim 13, wherein the first panel includes a first partial channel;

the second panel includes a second partial channel;

wherein when the first panel is attached to the second panel the first partial channel and the second partial channel form the channel extending substantially the first height and the second height, the channel shaped to direct water down toward the base and away from the one or more walls.

17. The shower unit of claim 16, wherein, when the first panel and second panel are attached:

the first partial channel is spaced from the exposed side of the first panel;

the second partial channel is spaced from the exposed side of the second panel; and the channel is shaped to direct water toward the collection area.

18. The shower unit of claim 17, wherein the channel includes a cross-sectional area that narrows as the channel approaches the base.

19. The shower unit of claim 13, further including a corner gasket shaped to engage the first panel proximate the first panel attaching side and the second panel proximate the second panel attaching side, wherein the corner gasket fluidly separates the wall side of the first panel and the wall side of the second panel from the collection area of the base.

20. The shower unit of claim 13, wherein the first panel further includes a first gasket positioned on the wall side proximate the first base end with the first gasket shaped to engage the base proximate the first edge of the base.

21. The shower unit of claim 13, wherein:

the first panel attaching side includes a vertical barrier that extends a majority of the first height;

the second panel attaching side includes a cavity that extends a majority of the second height;

the vertical barrier and the cavity form a retention cavity system when the first panel is attached to the second panel; and the baffling area is positioned between the retention cavity system and the exposed sides of the panels.

22. The shower unit of claim 21, wherein the retention cavity system extends to the first base end and is positioned to direct fluid under the first base end and into the collection area of the base.

23. The shower unit of claim 21, wherein the retention cavity system extends through the first interlocking member and the second interlocking member when the first panel is attached to the second panel.

24. The shower unit of claim 13, wherein the channel is positioned further from the exposed sides of the first and second panels than the baffle area is to the exposed sides of the first and second panels.

25. A shower surround comprising:

a base including a length, a width, a collection area, a first edge, and a second edge a first panel including a wall side, an exposed side, a first height, a first panel attaching side, a first base end, and a vertical barrier, the vertical barrier extending a majority of the first height, the first base end shaped to engage the first edge of the base, the first panel attaching side including a first interlocking member;

a second panel including a wall side, an exposed side, a second height approximately equal the first height, a second panel attaching side, a second base end, and a cavity, the cavity extending a majority of the second height, the second base end shaped to engage the second edge of the base, the second panel attaching side including a second interlocking member shaped to accept the first interlocking member and secure the first panel attaching side to the second panel attaching side; and wherein the vertical barrier and the cavity form a retention cavity system when the first panel is attached to the second panel, the retention cavity system spaced from the exposed sides of the panels and is shaped and positioned to direct fluid under the first base end of the first panel and into the collection area of the base, the retention cavity system including a cross-sectional area that varies, with the cross-sectional area consistently narrowing as the retention cavity system approaches the base.

26. The shower surround of claim 25, wherein a channel is positioned between the retention cavity system and the exposed sides of the panels.

27. The shower surround of claim 25, wherein the retention cavity system extends through the first interlocking member and the second interlocking member when the first panel is attached to the second panel.

28. The shower surround of claim 25, further including a corner gasket shaped to engage the first panel proximate the first panel attaching side and the second panel proximate the second panel attaching side, wherein the corner gasket fluidly separates the wall side of the first panel and the wall side of the second panel from the collection area of the base.

29. The shower surround of claim 25, wherein the first panel further includes a first gasket positioned on the wall side proximate the first base end with the first gasket shaped to engage the base proximate the first edge of the base.

* * * * *